US012467260B2

(12) United States Patent
Kirkey

(10) Patent No.: US 12,467,260 B2
(45) Date of Patent: Nov. 11, 2025

(54) SHINGLE ASSEMBLY, SYSTEM, AND METHOD FOR ASSEMBLING SHINGLES

(71) Applicant: Bryan John Kirkey, Amherst, MA (US)

(72) Inventor: Bryan John Kirkey, Amherst, MA (US)

(73) Assignee: Bryan John Kirkey, Amherst, MA (US)

( * ) Notice: Subject to any disclaimer, the term of this patent is extended or adjusted under 35 U.S.C. 154(b) by 195 days.

(21) Appl. No.: 18/532,855

(22) Filed: Dec. 7, 2023

(65) Prior Publication Data

US 2024/0360672 A1 Oct. 31, 2024

Related U.S. Application Data

(60) Provisional application No. 63/430,712, filed on Dec. 7, 2022.

(51) Int. Cl.
*E04D 3/02* (2006.01)

(52) U.S. Cl.
CPC ..... *E04D 3/02* (2013.01)

(58) Field of Classification Search
CPC ... E04D 3/02; E04D 1/265; E04D 2001/3423; E04D 2001/3447; E04D 2001/3461; E04F 2201/05
See application file for complete search history.

(56) References Cited

U.S. PATENT DOCUMENTS 2,080,912 A * 5/1937 Guy ..... E04D 15/04 227/129
2,097,051 A * 10/1937 Stock ..... B25C 5/16 227/125

* cited by examiner

*Primary Examiner* — Jason L Vaughan
*Assistant Examiner* — Amanda Kreiling
(74) *Attorney, Agent, or Firm* — Grogan, Tuccillo & Vanderleeden, LLP

(57) ABSTRACT

An assembly, and a machine for constructing the assembly, that provides a much faster and more precise shingle installation with optimized keyway spacing and offsets, and with built-in ventilation that improves the performance of the shingles and protects the wall assembly. Also providing a pleasing distribution of shingle widths with no apparent patterns.

20 Claims, 16 Drawing Sheets

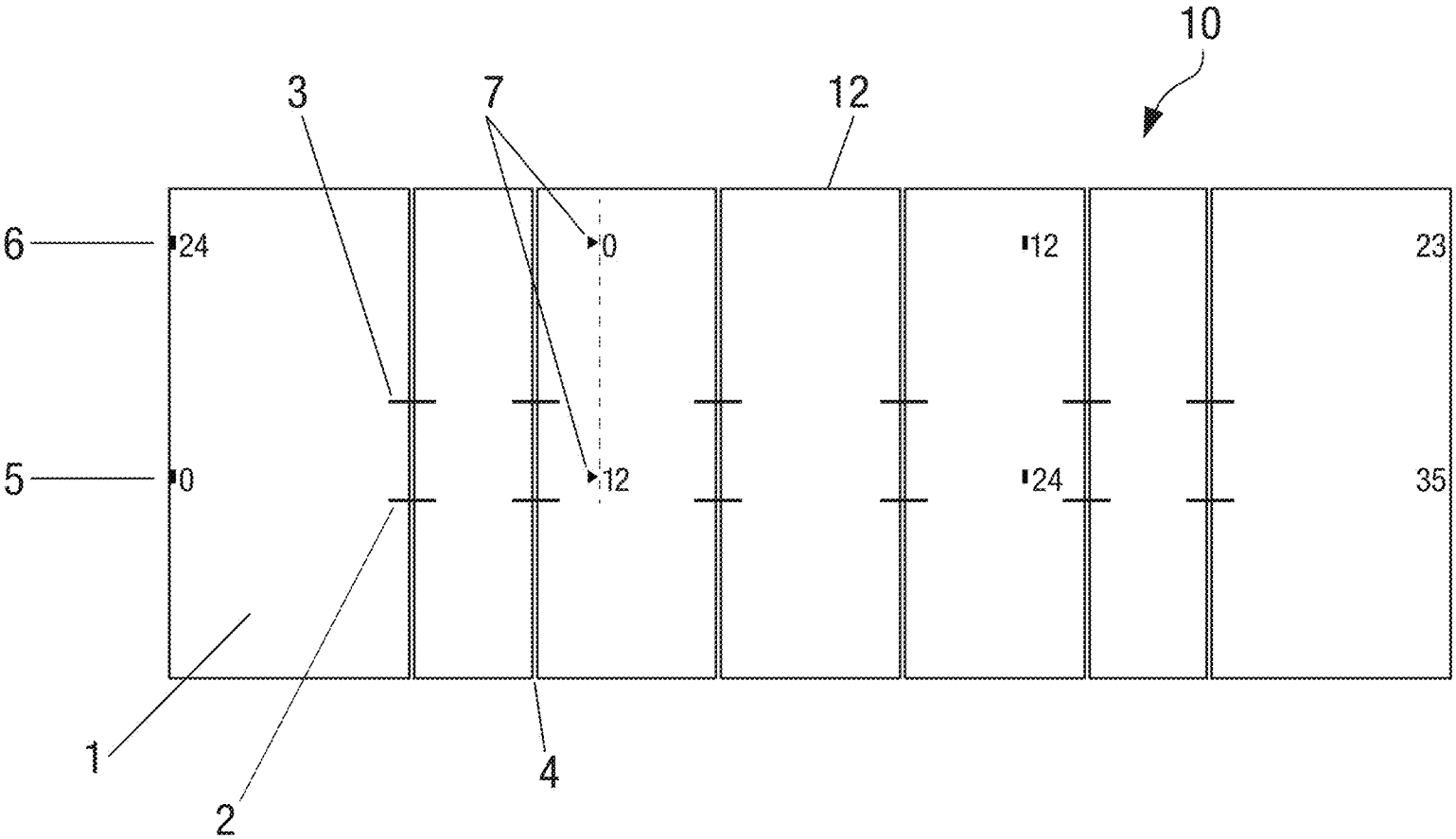
FIG. 1-A

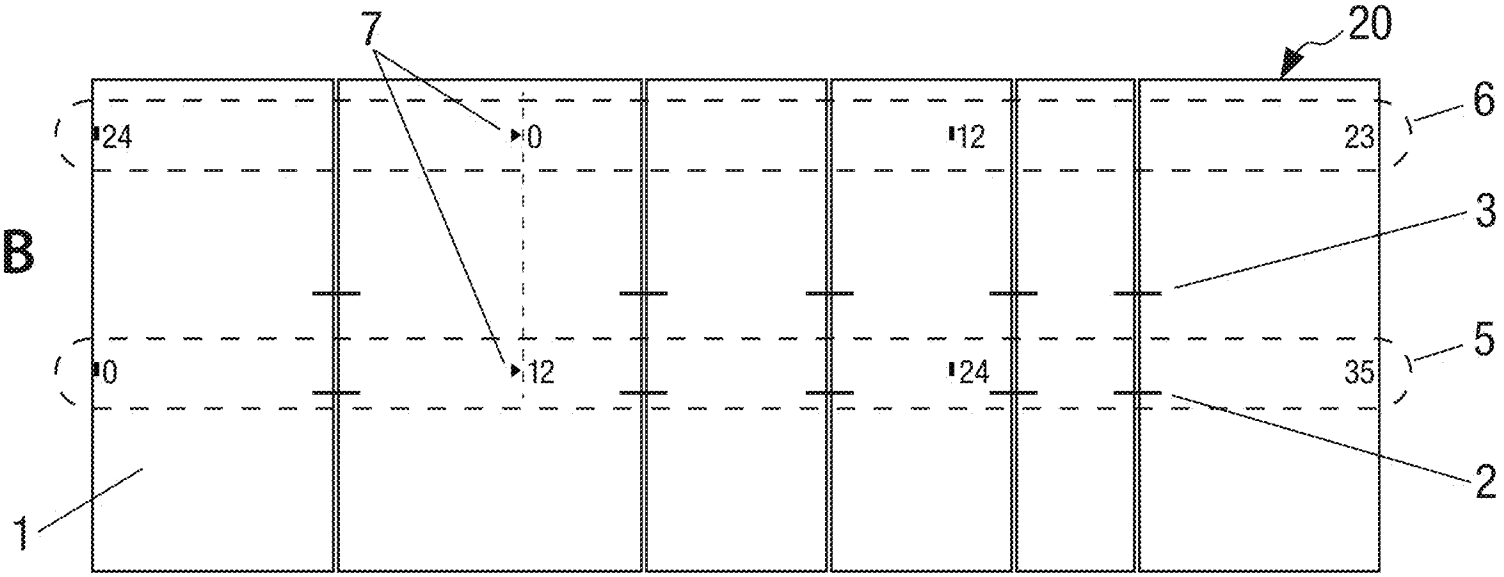
FIG. 1-B
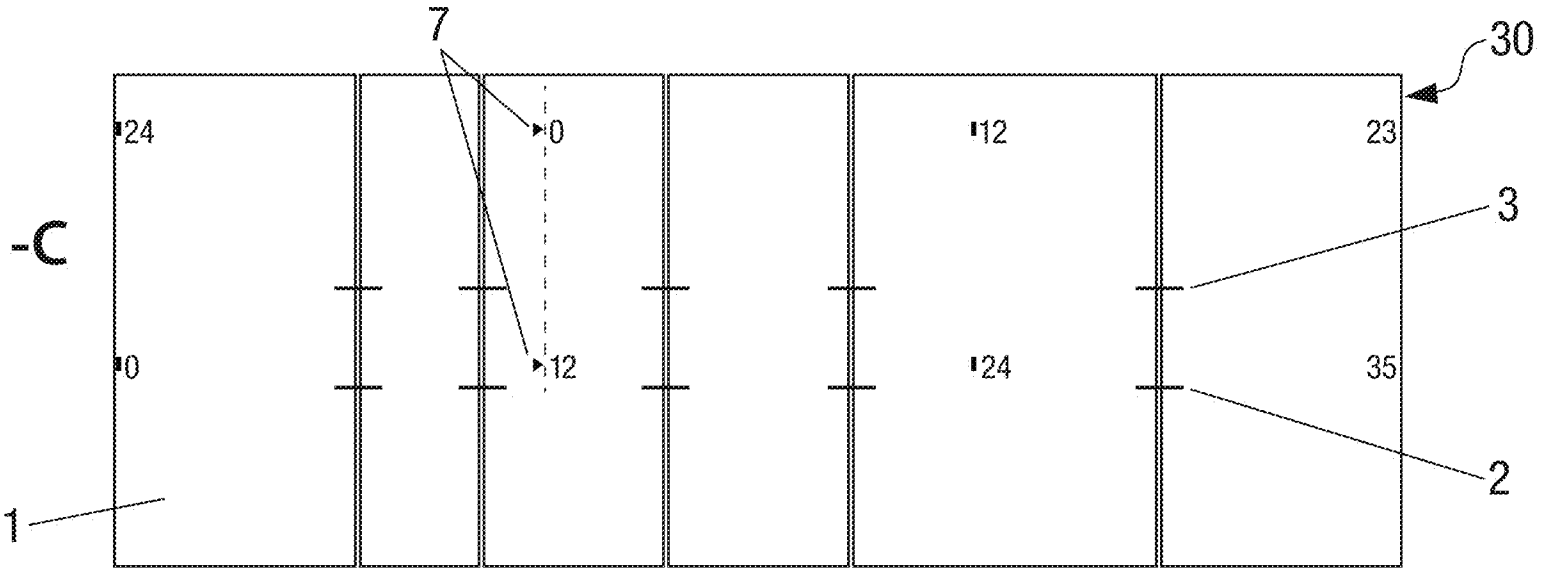
FIG. 1-C

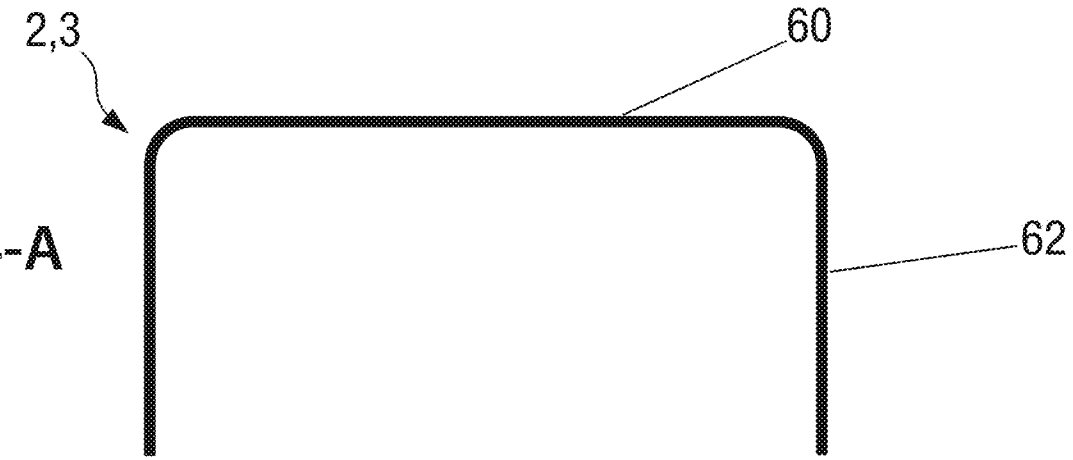
FIG. 4-A
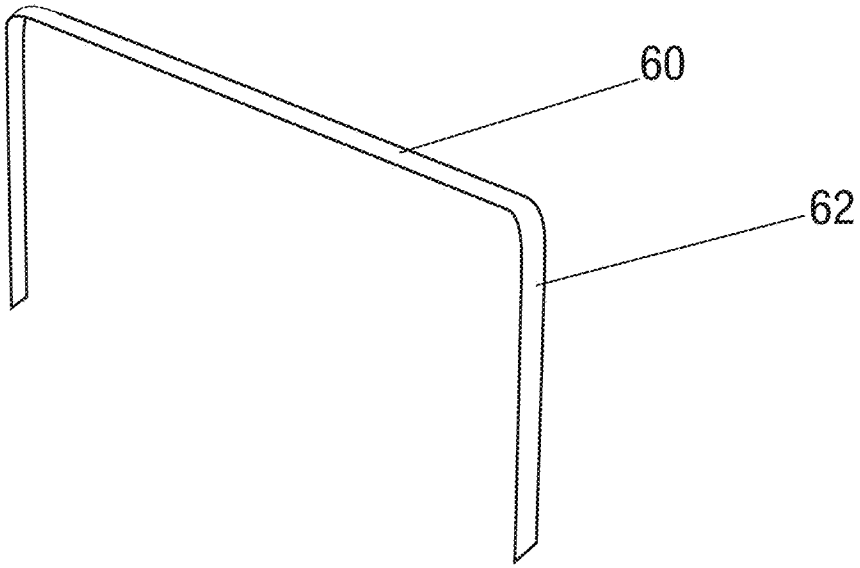
FIG. 4-B

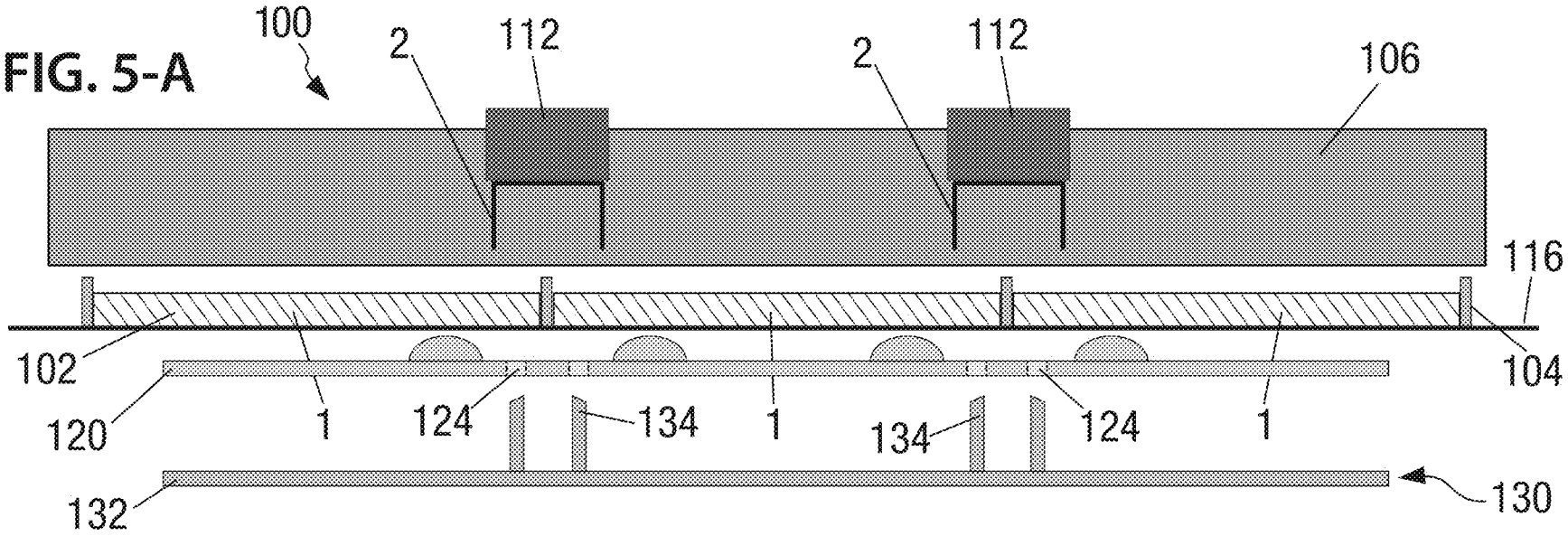
FIG. 5-A
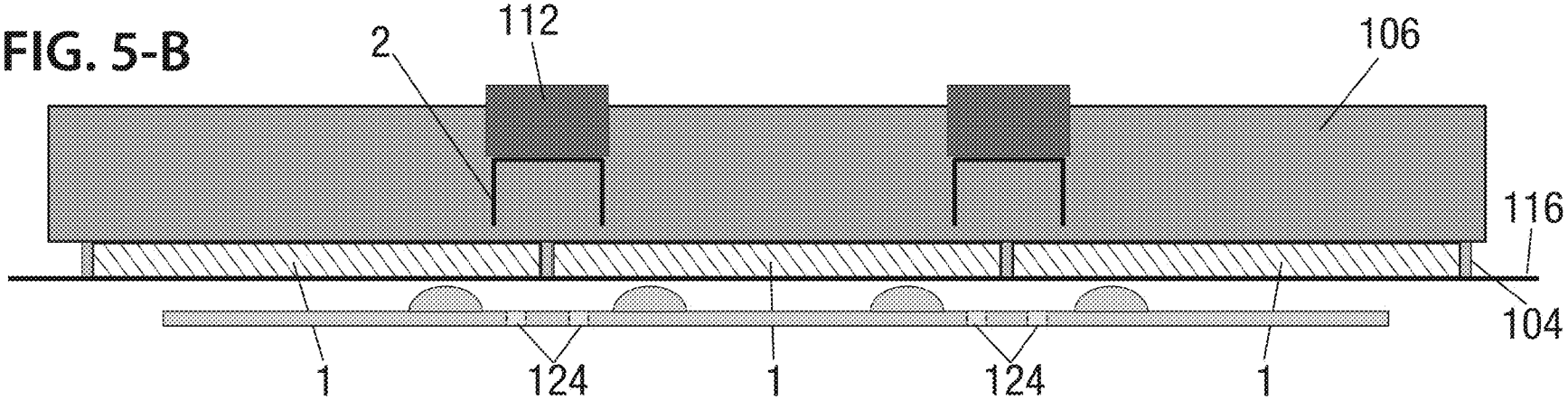
FIG. 5-B

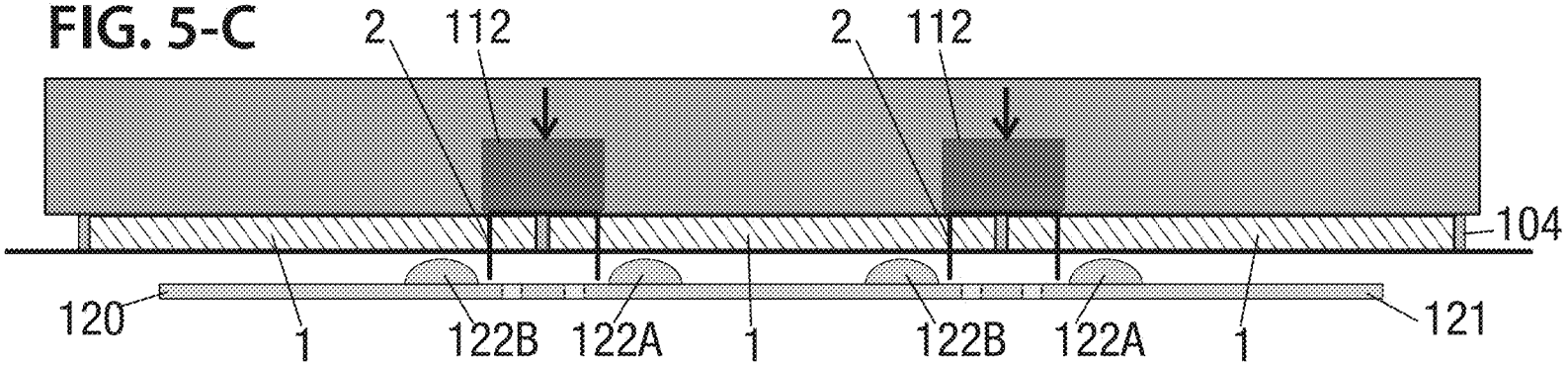
FIG. 5-C
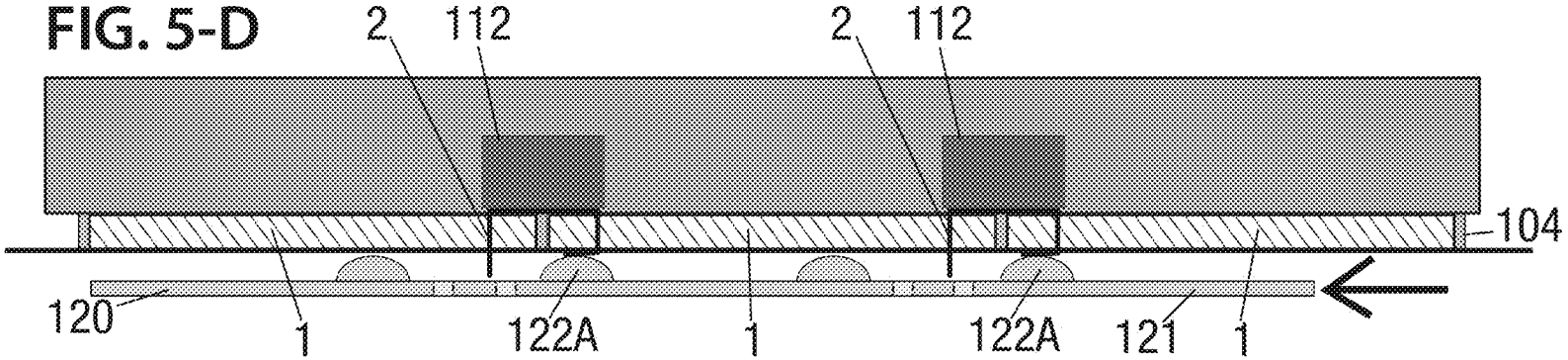
FIG. 5-D
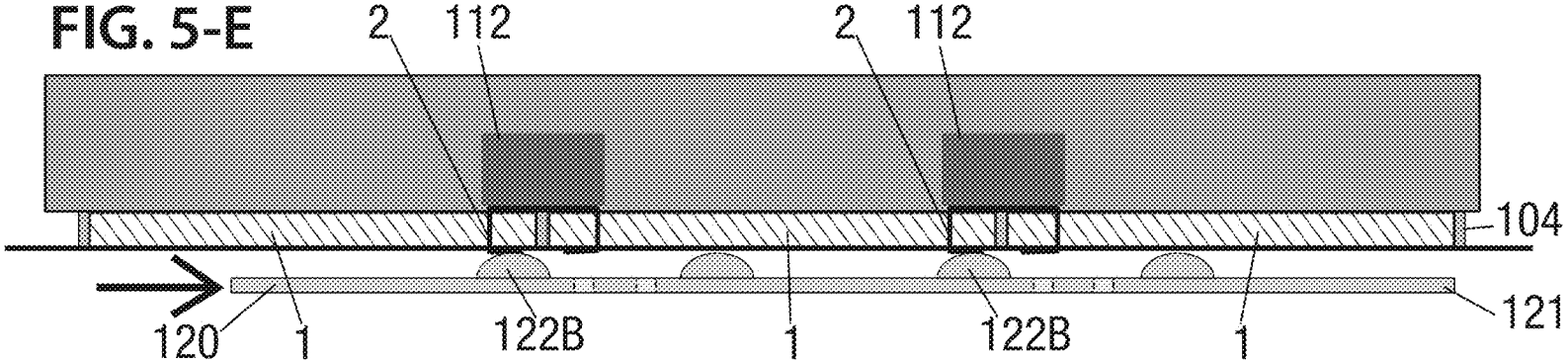
FIG. 5-E

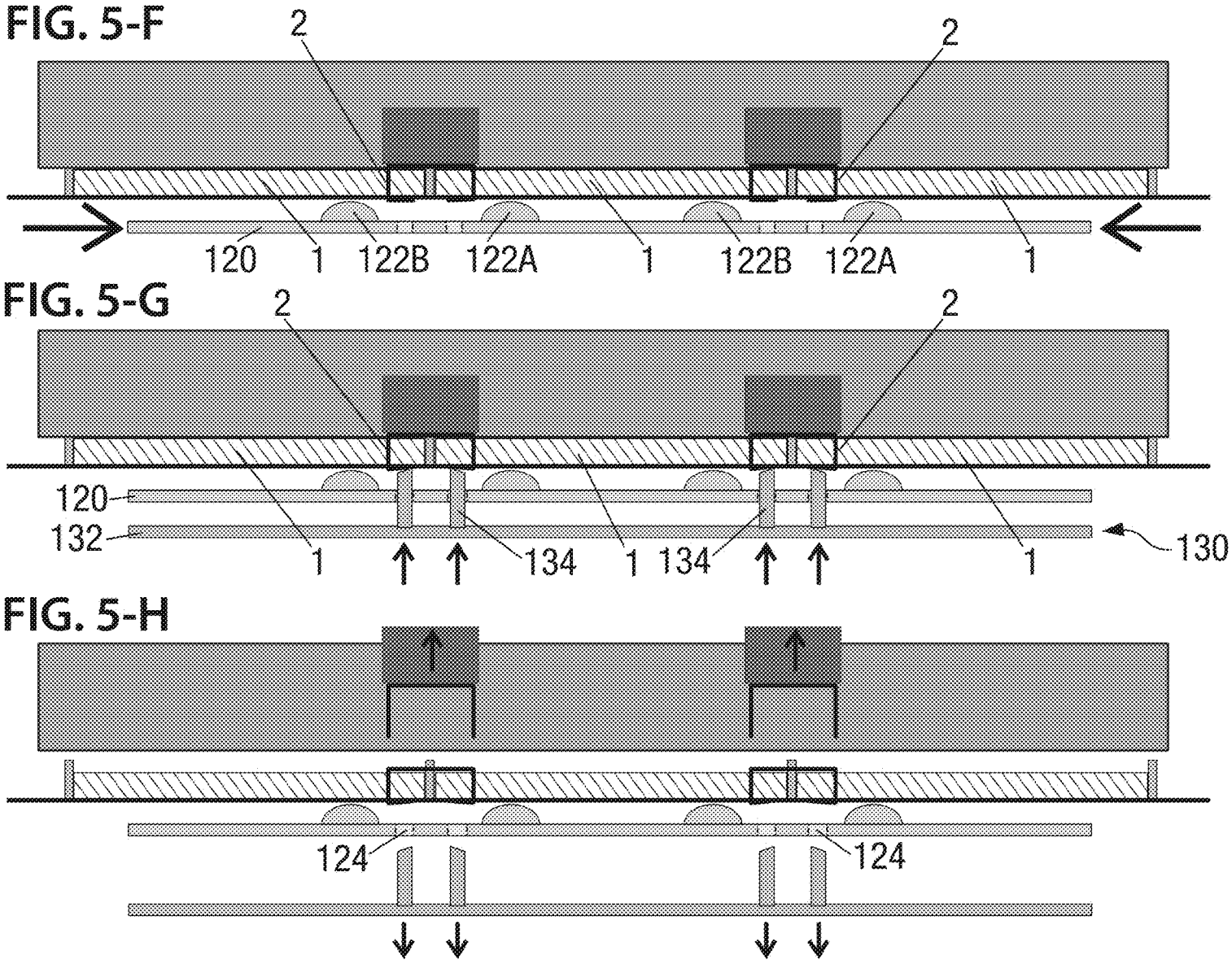
FIG. 5-F
FIG. 5-G
FIG. 5-H

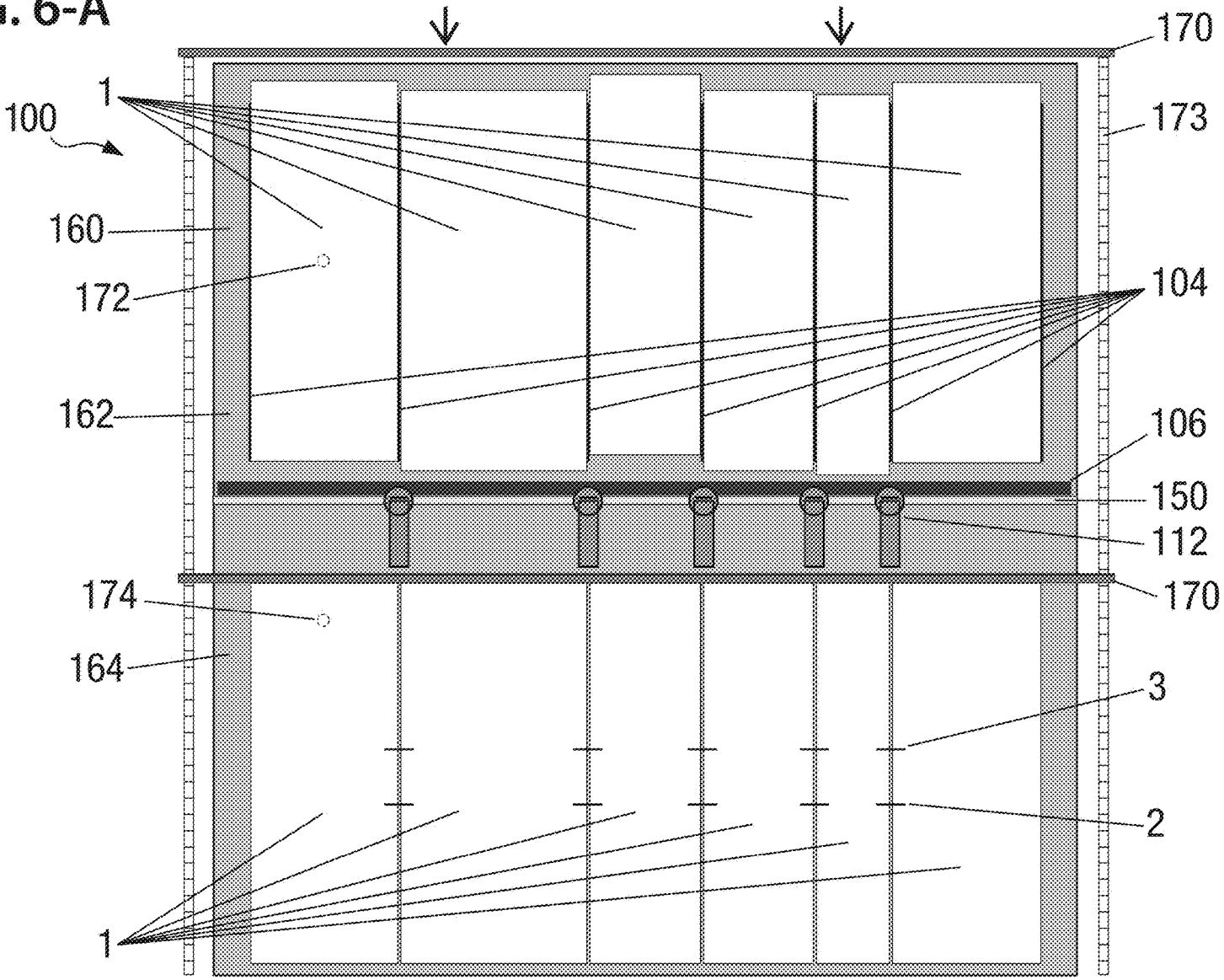
FIG. 6-A

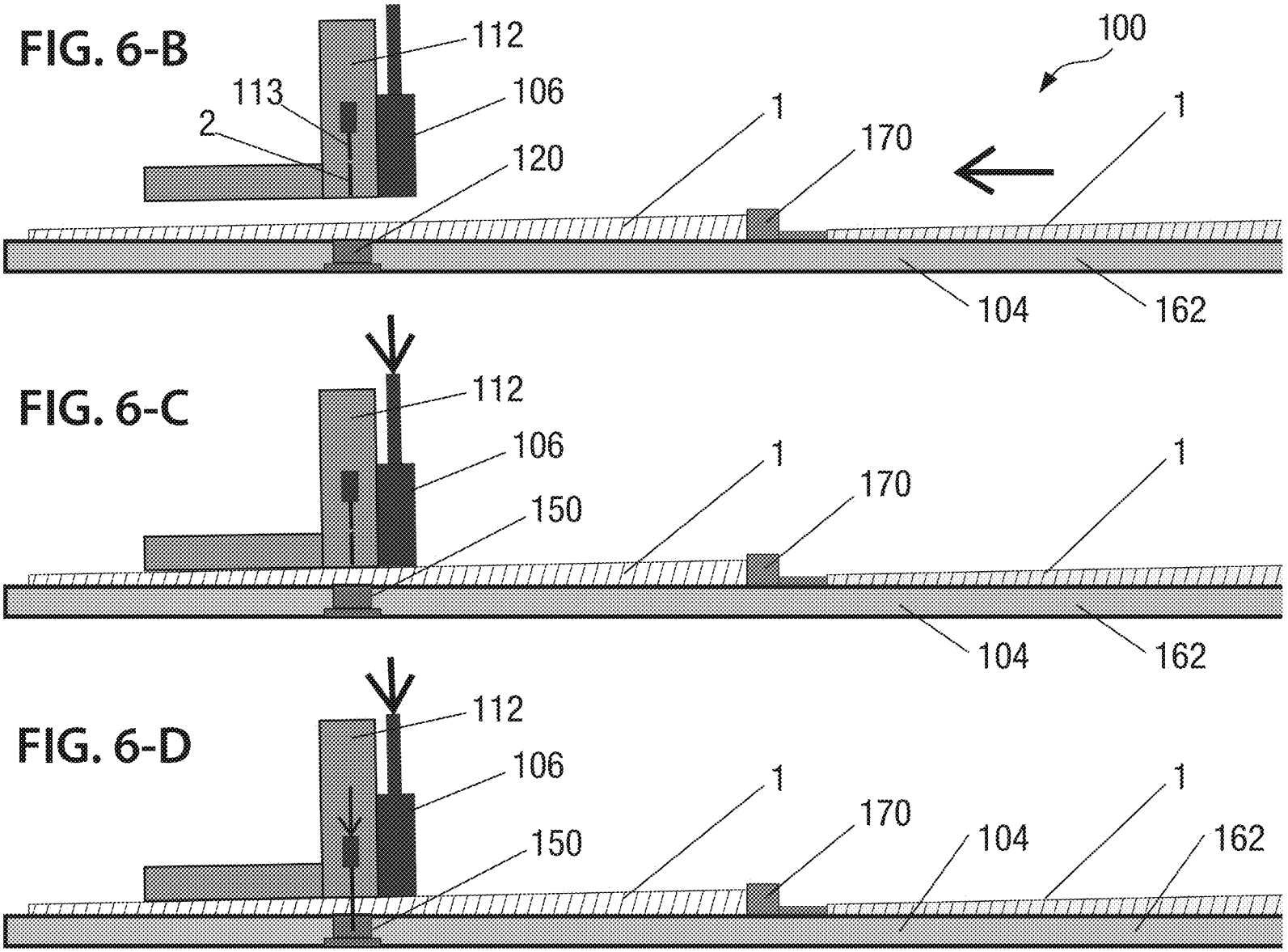
FIG. 6-B
FIG. 6-C
FIG. 6-D

SHINGLE ASSEMBLY, SYSTEM, AND METHOD FOR ASSEMBLING SHINGLES

CROSS-REFERENCE TO RELATED APPLICATIONS

The present application claims priority from U.S. provisional application No. 63/430,712 filed Dec. 7, 2022, which is incorporated herein by reference in its entirety.

FIELD OF THE DISCLOSURE

The present invention relates generally to the fields of roofing and siding and, more particularly, is directed towards pre-assembled panels of shingles or shakes as used in construction as a protective covering for roofs or sidewalls and methods and systems for manufacturing the same.

BACKGROUND

Shingles function as an excellent precipitation barrier by providing multiple layers of overlapping drainage planes that direct water back to the exterior surface of the roof or wall assembly. In a typical roof installation, only ⅓rd of the shingle is exposed resulting in 3 layers of shingles at any given point in the installation. Any water that leaks through joints between adjacent shingles in the top layer is redirected to the surface by shingles in the second layer. Any water that manages to penetrate the top two layers is redirected to the surface of the assembly by the third layer. For shingles to provide this highly weatherproof barrier, it is important that joints between adjacent shingles in each layer, are offset horizontally from the joints in the other two layers. The joints between shingles are commonly referred to as "keyways".

In comparison, lap siding is not nearly as weatherproof as a proper shingle installation and could never be used for roofing. End joints between adjacent sections of lap siding boards must be sealed to prevent leaks because there is no underlying course to redirect water back to the surface. Sealing joints between long lengths of siding is difficult because the joints expand and contract significantly with changes in temperature and humidity. Lap siding relies on the housewrap, or water resistive barrier (WRB), to function as a drainage plane for precipitation that leaks past the siding.

While cedar shingles provide a superior ability to shed precipitation, they also are considered to be one of the most aesthetically pleasing solutions for roofing and siding. Cedar shingles have been used for hundreds of years as a premium roofing and siding material, and have a proven history of durability and superior weatherproofing when properly installed. The random widths and natural variations of cedar shingles provide character and detail for flat surfaces, and the characteristics of the detail can be varied considerably by the size, exposure, and type of shingles, as well as by how the shingles are finished; either painted, stained, bleached or natural.

Cedar shingles also contribute to the energy efficiency of the structure. In roofing applications, tests have shown that, in hot weather, sheathing under cedar shingles is up to 40° F. cooler than sheathing under asphalt/fiberglass shingles, which can reduce cooling costs significantly. During cold weather, cedar shingles, because of their low density, provide better insulation than other types of roofing and siding materials. More importantly, well-ventilated dry insulation performs much better that wet insulation.

Although there are many advantages to cedar shingles when compared to other types of siding and roofing, there are significant problems associated with cedar shingle installation.

One of the most significant problems with conventional cedar shingle installation is that it is a very tedious and time-consuming process that requires skilled labor. Consequently, installation cost is high, and it is often difficult to find installers with adequate skills and experience. While typical 3-tab asphalt and composite shingles are installed as identical 36" wide strips, using a simple process for offsetting each course, conventional cedar shingles are installed individually, with random widths ranging from about 3" to 9". Multiple shingle widths, complicate the installation process, but are a necessary result of the production process for efficient recovery of raw material.

Guidelines and building codes for the installation of cedar shingles require a space or keyway between adjacent kiln dried shingles to allow for expansion of the shingles when they become wet. The keyways must be accurately and consistently sized for both function and appearance. Keyways that are too narrow will not allow shingles to expand enough when they become saturated, which will cause the shingles to buckle.

Additionally, according to generally accepted guidelines and building codes, keyways in each course must be horizontally offset from keyways in the previous 2 courses for roofing, and in the previous course for siding. The required minimum offset distance is 1 ½". Shorter offset distances will result in leaks when wind driven precipitation is blown sideways between shingles to nearby keyway locations. Maintaining proper keyway widths, and adhering to keyway offset requirements is tedious and time consuming. Proper installation requires spending a significant amount of time choosing the right shingle from bundles of random width shingles, as well as cutting shingles to a required width to ensure that each keyway joint is properly offset from the joints in the previous course(s). Often, installers do not completely adhere to the codes, and installations are compromised. Shingle manufacturers indicate that nearly all warranty claims are the direct result of improper installation.

Even when properly installed, cedar shingle installations present other problems that are caused by moisture trapped between shingle layers, and between the shingle assembly and the sheathing.

In a typical conventional cedar shingle installation, water is driven between overlapping shingles or courses by wind blown precipitation and drawn into the assembly by capillary action. Water trapped between two layers of wood requires a long time to dry and often results in decay if the moisture is sustained for a long enough period of time. It is well-known that wood stacked on wood without a breather spacer, and exposed to the weather, will result in decay. Also, as moisture is absorbed through the back of the shingles, it can cause the paint or stain on the front face of the shingle to fail.

Water trapped between shingle layers can also cause shingles to "cup" when the outer face of the shingle dries and shrinks while the back of the shingle is still wet and expanded. This problem is most pronounced when the saturated shingle assembly is exposed to direct sunlight.

When shingle layers are stacked tight against each other, moisture can soak through the entire assembly and become trapped between the shingle assembly and the underlayment (roofs) or housewrap (sidewalls). As with water trapped between courses, if the assembly has no ventilation to promote drying, prolonged moisture between the shingle assembly and the structure can result in decay. Additionally, according to some studies, the natural extractives in cedar can degrade the water repellency of some vapor permeable housewraps, allowing water to pass through the housewrap to the sheathing. It is common knowledge that cedar shingle installations provided significantly greater service life before the advent of waterproof housewraps and plywood sheathing. Cedar shingles roofs installed over spaced board sheathing, without underlayment, allowed the shingles assembly to dry to an interior ventilated attic space, as well as to the exterior. These more ventilated installations often performed well for over 30 years. More recent installations installed over solid sheet sheathing and roofing underlayment, without ventilation, typically need to be replaced in less than 10 years. A common practice of installing felt layers between courses, to prevent leaks when keyway joints are not properly offset, compounds the trapped moisture problem, causing even more rapid decay.

A more critical problem caused by moisture trapped in and behind a conventional cedar shingle assembly is often referred to as "solar vapor drive." Solar vapor drive can promote fungal decay and mold growth not just in the shingle assembly, but within the underlying wall structure. When cedar shingles in a sidewall installation become saturated with moisture from wind blown precipitation, capillary action, and high humidity, and when the saturated shingles are layered tight against each other and tight against the housewrap, the moisture in the assembly can be driven through the vapor permeable housewrap into the wall in the form of pressurized water vapor created by solar radiation. Once inside the wall structure, the vapor cools and condenses. Solar vapor drive functions much like a pump, forcing more moisture into the wall structure whenever conditions allow. Once inside the wall assembly, the moisture is contained by the housewrap or WRB, and any internal vapor barriers. A wall assembly that is subject to solar vapor drive can result in a significant level of mold and fungal decay within the wall in a relatively short period of time. If a structure is otherwise maintained, the rate of moisture infiltration from solar vapor drive often will determine the life of the structure.

Recognizing the extent of problems caused by leaky siding and solar vapor drive, industry professionals have developed "rain-screen" installation methods as a solution. The rain-screen concept has been adapted as a requirement of some sustainable building programs as well as some local building codes. A rain-screen installation incorporates a means to create an air space between the siding material and the sheathing. This gap provides a drainage plane for leaky sidings, and, when properly ventilated, also serves to depressurize solar vapor drive.

One problem with rain-screen installations is that they are difficult to ventilate. Instructions to provide screened vents at the top and bottom of walls and above and below windows are often ignored by builders because it is difficult to create the vents without significantly compromising the appearance of the wall. Building screened vents, as well as building out door and window jambs to accommodate the additional wall thickness, complicates the siding installation process and increases cost.

An unventilated rain-screen installation solves some problems, but the unventilated dead air space between the siding and the sheathing can cause another type of moisture problem. Hot humid air that migrates into this space during the day will condense as temperatures drop, typically in the evening. This dead air space can generate moisture from condensation on a daily basis, even if there is no precipitation. As with moisture from other sources, fungal decay can result if the moist conditions are prolonged.

Several products have been developed to make the installation of cedar shingles less tedious and time consuming. A number of shingle panels have been patented and/or marketed as a means to install a group of shingles at one time. These concepts generally fall into three categories, as follows:

The first category includes panels comprised of a veneer of shingle segments, representing the exposed butt section of the shingles, attached to a plywood or a solid wood backer board, with the backer board fully, or nearly fully, containing the shingle segments. This type of panel provides a cedar shingle "look", but there are no shingles in the assembly, and the panels do not install as shingles. These products install as a lap siding, with a relatively small overlap, and do not provide the higher level of performance of a proper shingle installation. They are more prone to leaks, and could never be used as roofing.

Because this type of panel installs as a lap siding, with horizontal lap joints, it must be installed at one fixed exposure (the height of each course). Unlike shingles, the exposure cannot be modified or "cheated" during installation to adjust the relationship of courses with other elements such as window sills, trim and frieze boards, or to align with such elements when they are not level or parallel to each other.

Shingle segments in this type of panel cannot be back primed to improve the performance of the finish because they are attached to the backer board. They also cannot expand and contract independently of the backer board, and the shingle segments are prone to delaminating.

Still another disadvantage of this type of panel is that it depends on a special overlapping edge joint to connect side-by-side panels in a course. Because panels cannot be properly joined without this special lap joint, partial panels cannot be reused, resulting in a high percentage of waste.

The alignment of keyways with this type of panel is irrelevant because these panels do not function as shingles. The top and bottom edges of the panels overlap slightly to enable drainage from one panel course to the next, but the assembly does not function as shingles with multiple layers of drainage plains. The horizontal and vertical joints between panels have a relatively small overlap, and a much greater potential to leak than conventionally installed shingles. For this reason, these panels can only be used for sidewalls, and not for roofs.

The second category of existing shingle panels includes shingle elements that may be up to full size, but still do not function as shingles because they are attached to a backer board. The backer board may be plywood or solid wood, and extends the full width of the panel. The lower portion of the shingles extends past the bottom edge of the backer-board to overlap the previous course. As with the first category of panels above, these products install as a lap siding, and do not provide the higher level of performance that a shingle installation provides. They are more prone to leaks, and could never be used as roofing. Because they install as a lap siding, not as shingles, these products have many of the same problems outlined above for panels with full backer-boards.

In the third type of panel, shingles are attached to a board that extends the full width of the panel at the top of the shingles on the front side. The board is relatively thin and narrow because it remains in place between courses. However, the board is thick enough that it eliminates the bowed shape that shingles normally assume, from butt to tip, when they span between the previous course and the sheathing.

This bowed shape provides a spring like tension that helps shingles stay flush against the previous course, and eliminates gaps between courses. With this type of panel, shingles don't lay flat and flush on the previous course. Because of the board between courses, a space is created between the layers of shingles. This space allows wind blown precipitation to move sideways between layers where it can access underlying keyways and pass through to the sheathing. Again, as with the other panels, this type of panel is less weatherproof than conventionally installed shingles and cannot be used for roofs.

In addition, because this panel is joined only with one thin board attached to the thin end of the shingles, this panel is relatively fragile. Shingles can be easily damaged or knocked out of alignment. Because of its lack of strength, the panel is necessarily limited to a relatively short width, which is too short to provide sufficient keyway offsets over multiple courses and eliminate diagonal patterning. Following the instructions for the installation of this product results in strong diagonal stair step patterns throughout the installation, as well as keyway placement that does not meet building code requirements.

To summarize, all of the panel options in the three categories above intend to provide a faster cedar shingle installation, yet while some may install faster, none of them provide an actual conventional shingle installation, or an installation that is comparable to the performance of an actual shingle installation. In each case, attaching the shingles to a board or strip either converts the installation from a shingle installation to a less weatherproof lap siding installation, or it significantly impairs the function and appearance of the installation as shingles. None of the above options meet well established cedar shingle code requirements, none can be used where cedar shingles are specified in building plans, and none of the above options can be specified for roofing.

If the boards in the panels reviewed above were reduced in thickness to the point where they no longer compromised the function of the shingles, replacing the boards with thin flexible bonding strips as in some prior art (Smith, Jr., U.S. Pat. No. 1,467,510), then the panels would not be sufficiently rigid to form and maintain a panel of aligned shingles with the required keyway spaces between shingles. The panels would not maintain the alignment of shingles during normal installation and handling, keyway spaces would deform, and the butts would not form a straight line when installed. A bonding strip sufficiently rigid to maintain the position of shingles and keyway spaces would not allow the shingles to expand and contract normally.

A fourth type of shingle panel is one previously developed by this inventor (U.S. Pat. Nos. 8,256,185 B2, and 8,347,578 B2) and assigned to Ecoshel, Inc. The shingles in this panel were held together as a panel using four bonding strips, two on the front and two on the back. The lower bonding strip on the front was attached to removable keyway spacers and was removed, along with the spacers, after installation. The keyway spacers maintained a consistent keyway space during panel assembly, and served as a structural element that prevented the panel from deforming during handling and installation. With the keyway spacers removed, the shingles could expand and contract as needed. Unlike the other types of panels discussed above, the full-size shingles in this panel were not attached to a backer-board, or a rigid strip, so they did function as conventional individual shingles, and could be used for roofing as well as siding. Essentially this panel was a system for providing a faster, and code-perfect installation of conventional full size cedar shingles that followed all standards and codes for cedar shingles, including keyway widths, keyway offsets, and nailing requirements. Once the inter-shingle spacers were removed the result was an authentic, and well executed, conventional cedar shingle installation.

However, there were potential problems with this panel configuration discovered in practice, as follows:

The removable front strip, which was necessarily installed with removable adhesive, sometimes detached from the shingles during handling and installation, which caused the panel to deform or fall apart. Using a stronger adhesive pulled out wood fibers when the strip was removed, compromising the appearance.

The same removable strip sometimes detached from the spacers, failing to pull the spacers out of the keyways, and requiring that individual spacers be removed one at a time by hand.

The upper front face of the shingles, where another bonding strip was attached, could not be pre-finished, and this unfinished section, the strip, was visible through the keyway spaces of the next course.

The cost of production to install 4 bonding strips, 2 of them printed, was relatively high, and the removable strips and spacers created a significant volume of waste at the job site.

A more recent version of this panel, developed and tested by this inventor, used a keyway spacer that allowed the shingles to expand and contract, so the spacer could remain in the installed shingle strip assembly, rather than being removed after installation. These spacers were held in position during assembly by slots punched in the front surface of the shingles that accepted tabs on the spacers. Two bonding strips installed across the back of the shingles, one at the top, and one in the middle, connected the shingles to each other and held the spacers in place between shingles. The spacers and the bonding strip were substantially contained within the plane of the shingles, so the resulting installation functioned as conventionally installed shingles. However, testing this more recent shingle assembly revealed significant structural problems.

The keyway spacer was held in position by a small tab that engaged a shallow slot punched in the front face of the shingles. The spacer often disengaged from the slots when the shingles expanded, or when the joint was bowed, during typical handling for manufacturing, packaging, and installation. When the spacers detached, the bonding strip across the back of the assembly prevented the panel from completely falling apart, but breaks at the shingle joints deformed the panel causing installation problems. Broken panels were difficult to handle and could not be easily repaired in the field. Installing panels with broken joints resulted in uneven keyway spacing, misalignment of shingle butts, and a crooked installation. When spacers disengaged from the punched slots, they protruded beyond the plane of the shingles, which prevented overlapping panels from laying flat, creating a gap between courses that compromised appearance, as well as the weatherproofing performance of the installation. The result was an installation that did not consistently perform as well as a proper conventional cedar shingle installation. The goal of achieving a faster more precise installation was compromised by the failure of the panel structure. The time savings of the prefabricated system was substantially offset by the additional time required to install deformed panels, and by the cost of replacing irreparable broken panels.

The bonding layers of this panel assembly caused additional problems. When the shingles expanded as moisture content increased, a normal event, the bonding layers installed across the width of the panel on the back, restricted expansion of the shingle widths across the back surface, which caused "pillowing". As the front of the shingles expanded across the width of the shingles, without restriction, the shingles would deform into a convex shape. The bonding layers also caused problems with pre-finishing. When the shingles were painted front and back, as is normally required for best performance, the finish applied on top of the bonding layers could not be absorbed by the wood, and consequently required a very long time to dry/cure. This is an unacceptable problem for a high-volume pre-finishing operation because of the excessive drying space required.

The most recent shingle assembly developed and produced by this inventor (patent application Ser. No. 16/266,097, which is incorporated by reference in its entirely) uses only clips between adjacent shingles to achieve the shingle assembly. This inter-shingle clip has tabs that engage slots on both the front and back of the shingle, eliminating the need for bonding strips on the back of the shingles. This most recent assembly solves many of the functional problems associated with previous shingle assemblies, however, manually connecting the shingles to each other with the inter-shingle clip is a tedious, time-consuming process, and automating this assembly process would be excessively complicated, costly, and impractical.

Another problem with this most recent version is that the inter-shingle clip does not work in shingle assemblies that require a narrower keyway space, as with an assembly of eastern white shingles. The preferred installed keyway space with kiln dried eastern white cedar shingles is ⅛". With this narrower keyway, the section of the clip that is between the shingles prevents the shingles from expanding adequately.

Thus, there is a need in the art for a shingle assembly, manufacturing system, and manufacturing method that ideally meets the following criteria:

- will enable a much more rapid installation of shingles as compared to the conventional method of installing shingles one at a time;
- will not compromise the function and performance of the individual shingles in the set as compared to individual shingles properly installed in a conventional manner, and as such, can be used for projects where shingles are specified in architectural plans;
- will be such that persons with little or no particular knowledge, relevant experience, or skill, can feasibly install the product and achieve results of the highest quality;
- will be such that keyways are of a precise and consistent width;
- will be such that the method of securing the shingles to each other allows the shingles to expand and contract normally, including shingles that are normally installed with a narrow keyway space that often closes completely when the shingles expand;
- will include markings or guides to indicate the proper placement of each subsequent shingle assembly during installation, as necessary to maintain a pattern of proper keyway offsets;
- will result in keyway offsets of at about 1 ½" or greater over any 3 consecutive courses, by properly registering each course with the previous course;
- will include shingles of multiple widths and will result in a balanced distribution of various shingle widths and no apparent repetitive patterns;
- will enable fast, precise, efficient, and cost-effective assembly by machine.
- will be interconnected in a manner that does not add substantial thickness to the shingles and will not affect the position of the shingles or how the shingles lay with respect to each other and the underlying sheathing, as compared to a conventional individual shingle installation, thus maintaining function and performance in line with conventionally installed shingles;
- will be manufactured such that the method of securing shingles in position in the set will provide measures to prevent shingles from being knocked out of alignment or easily damaged during shipping, handling, or installation. (i.e., the shingle set will be durable enough that it can be handled in a manner typical of similar construction products without damage);
- will be such that an integral ventilation system further enhances the performance of the shingles;
- will be such that an integral ventilation system prevents moisture from infiltrating the wall assembly.

BRIEF SUMMARY OF THE INVENTION

The various features, aspects and embodiments of the present invention, together with unique manufacturing machinery, cooperatively provide a shingle assembly, integrated with a unique installation system, that results in an authentic, perfected, conventional cedar shingle installation with the added benefits of integral ventilation, and a fast and easy installation process that provides substantially uniform and equal keyway spaces, and proper keyway offsets, automatically. Advantageously, embodiments of the present invention alleviate the moisture related damage that can result from improper shingle installation, unventilated shingle installation, or the use of inferior ventilation products.

In an exemplary embodiment of the present invention, the shingles are connected to each other, not to a backer board or bonding layer. When installed, they function as full-size shingles, not as panels with a shingle "look". The installation system provides full triple layer coverage and the same superior weatherproofing as conventional full-size shingles, properly installed. Other siding products, such as shingle panels and clapboards, do not have sufficient overlaps to prevent leaks. This is why they are not adequate in roofing applications. However, in extreme weather, wall coverings must perform as well as roof coverings to prevent damage from wind driven precipitation. Essentially, wind can replace gravity as a force that drives moisture inward through the layer(s) of protective covering.

Cedar shingles provide a highly weatherproof barrier when properly installed. Proper installation means that the keyways (the joints between adjacent shingles) must be offset from the keyways in the next two courses above and below the current course. The minimum offset imposed by building codes for adjacent courses is 1-½inches. Meeting this requirement, when installing shingles conventionally, is a very tedious and time-consuming process. Consequently, this code requirement is often ignored or compromised, resulting in leaks.

Another advantage of various embodiments of the present invention is that they operate to reduce the work involved in the shingle installation process. The system is carefully calculated to provide optimal keyway offsets, and a well-balanced appearance of multiple shingle widths, automatically. Installation is a simple process of aligning each new course with guide marks on the previous course. Keyways will be offset by at least the minimum required distance over 3courses, as required for roofing, and there will be no apparent patterns, and no clusters of narrow or wide shingles.

The shingles in the various embodiments of the present invention are attached to each other, not to a backer board. This allows for a true shingle installation with full triple layer overlaps for superior weatherproofing. Unlike pre-assembled shingle panels with a backer board, there are no special side lap panel joints that can be a source of leaks, and that result in wasted cut-off sections. Also, unlike shingle panels, the various embodiments of the present invention allow the proper use of flashing between the shingle layers to re-direct water to the exterior. Because there is no backer board, the shingle strips in embodiments of the present invention can be cut with a knife, and details such as corners, hips and ridges are handled just as with conventional shingles. There are no additional proprietary components that need to be ordered and installed to create these details.

In addition to superior weatherproofing and much faster installation, the pre-assembled shingle strips also provide enhanced ventilation. Ventilation ridges on the back of the shingles provide a slight space between shingles, and between shingles and the house wrap (weather resistant barrier). These ridges will create numerous airways that run from the backside of the shingles, between shingle layers to the exterior, as distinct from an airspace contained behind multiple layers of shingles. These airways enable airflow, which promotes drying. The ridges will also create a capillary break between shingle layers and between shingles and the house wrap, preventing exterior moisture from soaking inward toward the building sheathing. The small size, consistent height, and vertical orientation of the ridges will also function as baffles that prevent windblown precipitation from moving laterally between shingle layers and passing through hidden offset keyway openings. This built-in ventilation prevents moisture related mold and decay fungi in several ways as follows:

Prevents water from being driven into the wall by solar vapor drive by providing ventilation throughout the shingle assembly that enables pressurized water vapor to vent more easily to the exterior than through the vapor permeable house wrap.

Provides a capillary break between shingle layers that helps isolate moisture to the top layer, and prevents moisture from being drawn into the wall or roof assembly by capillary action. Allows saturated shingles to dry on both sides, which reduces shingle cupping.

Provides an air space between the shingle assembly and the house wrap or sheathing that meets rain-screen installation specifications, and works with the ventilation throughout the shingle assembly to depressurize solar vapor drive.

Prevents contact between the house wrap and extractives in cedar shingles, which may degrade the water repellency of some house wraps.

Creates baffles that prevent windblown precipitation from moving sideways between shingles to underlying keyway locations.

Eliminates the need for other problematic ventilation or rain-screen systems.

Another advantage of the various embodiments of the present invention is that they provide ventilation to the exterior throughout the entire surface. Other systems, which use lath or mesh between the shingles and the sheathing, create an air space, not ventilation. If this airspace is not properly ventilated it will create an additional source of moisture as warm humid air cools and condenses, or is pressurized and diffuses through the vapor permeable house wrap. It is very difficult, if not impossible, to adequately ventilate an airspace system. Continuous screened vents are required at the top and bottom edges of the installation, and above and below all windows, chimneys, dormers, etc. Adding these vents can make exterior trim work awkward and unattractive. In addition, the additional thickness of the airspace requires the use of jamb and sill extensions on windows and doors.

Independent of the installation system that manages the keyway positions, another aspect of the invention is that the shingle assembly provided is not mounted to a board, and thus maintains the superior functional performance of shingles. The inter-shingle clips are substantially contained within the plane of the shingles, maintain true shingle functionality and performance. The flexibility of the clips allows the shingles to expand and contract, maintaining the structural integrity of the assembly as the panel is bowed or flexed in normal handling for installation.

Embodiments also provide a system and method that automates at least a portion of the shingle panel manufacturing process to provide an ease of manufacture that is not currently available with known shingle assemblies.

These and other features, aspects, advantages and embodiments of the present invention are better understood by reviewing that attached figures and the accompanying description.

BRIEF DESCRIPTION OF THE DRAWINGS

FIG. 1-A is a plan view of the shingle assembly of the present invention.

FIG. 1-B and 1-C are plan views of the shingle assembly of the present invention showing shingle pattern variations.

FIG. 4-A is a cross section of the clip or connector of the present invention.

FIG. 4-B is a perspective view of the clip or connector of the present invention.

FIG. 5-A shows the components of the clip installation and clinching mechanisms of a machine in accordance with an embodiment of the present invention, and the shingles, in the load position.

FIG. 5-B shows a primary clinching mechanism of the machine of FIG. 5-A with the gun mount bar pressed against the shingles.

FIG. 5-C shows the primary clinching mechanism of the machine of FIG. 5-A with the gun mount bar pressed against the shingles and the clips driven through the shingles.

FIG. 5-D shows the primary clinching mechanism of the machine of FIG. 5-A moved in one direction to clinch one leg of the clips.

FIG. 5-E shows the primary clinching mechanism of the machine of FIG. 5-A moved in the opposite direction to clinch the other leg of the clips.

FIG. 5-F shows the primary clinching mechanism of the machine of FIG. 5-A returning to the centered load position FIG. 5-G shows the punches of a secondary clinching mechanism of the machine of FIG. 5-A clinching the clips further into the shingles.

FIG. 5-H shows the gun mount bar and the punches of the secondary clinching mechanism of the machine of FIG. 5-G returning to the load position.

FIG. 6-A is a top view of the machine of FIG. 5-A showing shingles as loaded on the infeed side of the clipping mechanism, and the assembled shingle-strip on the outfeed side.

FIG. 6-B is a side view of the machine of FIG. 5-A showing a set of shingles advanced by the push bar to a clipping position.

FIG. 6-C is a side view of the machine of the present invention showing a set of shingles in a clipping position, with the gun mount bar pressed against the shingles.

FIG. 6-D is a side view of the machine of the present invention showing a set of shingles in a clipping position, the gun mount bar pressed against the shingles, and the clips driven through the shingles.

DETAILED DESCRIPTION OF THE INVENTION

Figure 2:
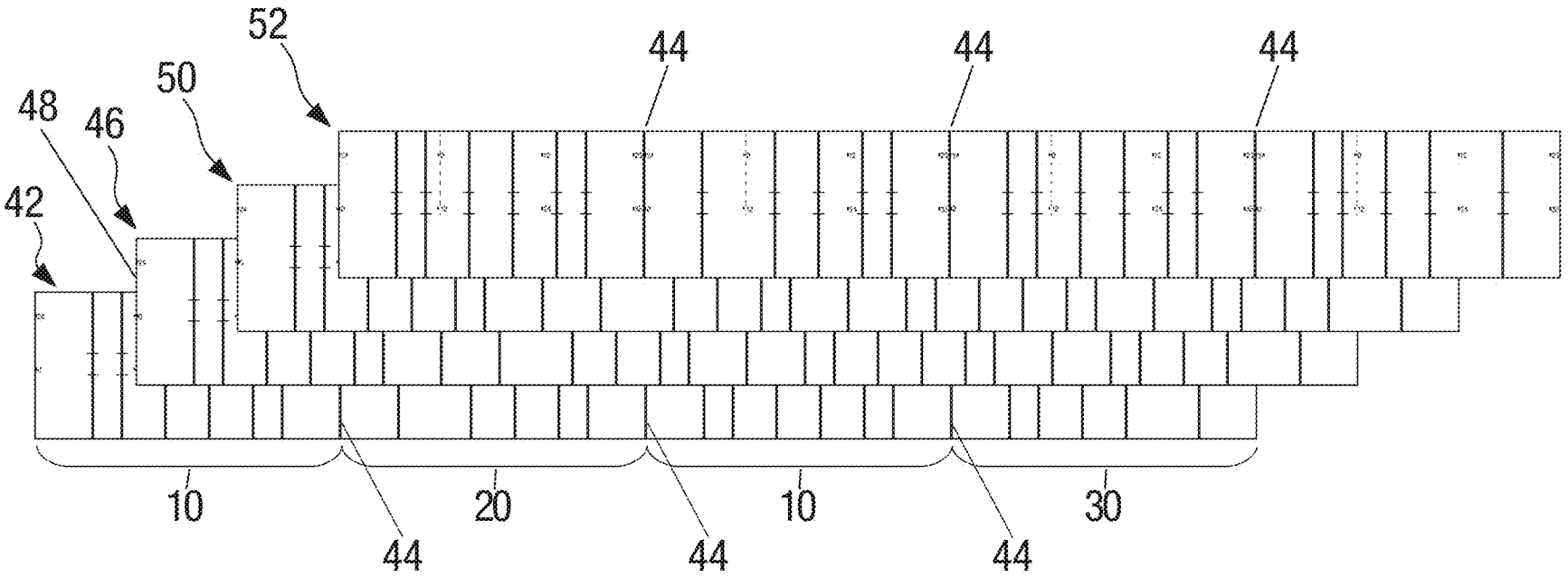
FIG. 2 is a view of an installation of the shingle assembly of the present invention.

The present invention, as well as features and aspects thereof, provides a shingle assembly to aid in the proper installation of shingles, a machine and a method for efficiently manufacturing the shingle assembly, as well as a method for installation of the shingles. In general, embodiments of the invention provide panels of shingles that have alignment guide marks, that when followed, result in the installation of shingles that meet keyway space requirements and keyway offset requirements, and also provide an aesthetically pleasing distribution of the shingles. Embodiments of the invention also enable a much faster installation, with greater precision than is typically achieved in conventional installation, and include a built-in ventilation system that improves the performance of the shingles.

As used herein, the terms "shingle-set", "shingle-strip", "shingle panel", or "panel" are used interchangeably to describe a shingle assembly. As will be appreciated, embodiments of the invention may be suitable for manufacturing panels or assemblies of shingles or shakes and, as used herein, the term "shingle" encompasses/includes shakes.

While embodiments of the invention are described for use with shingles that are produced from Western Red Cedar, Eastern White Cedar, or Alaskan Yellow Cedar, the invention is not so limited, and there are other durable rot resistant woods that can be used effectively. Additionally, embodiments may be used with various synthetic shingles. For simplicity, the terms "shingle" or "cedar shingle" will be used as representative of shingles or shakes of any composition. Embodiments of the invention are likewise not limited to any specific shingle size.

Turning now to the figures in which like labels refer to like elements through the several views, various features, aspects and embodiments of the present invention are described.

FIG. 1-A is a conceptual diagram illustrating the front-side of a shingle-strip or shingle panel or assembly 10 according to an embodiment of the invention. In this embodiment, showing seven shingles that vary in width from about 3-¼" to about 6-¾" forming a shingle-strip that is about 36" in width, and about 17-¼" high. FIG. 1-A includes seven shingles 1, with spaces or "keyways" 4 between the shingles 1 to allow for expansion, a lower row of six lower shingle clips or fasteners 2, and a row of six upper shingle clips or fasteners 3.

As will be appreciated, embodiments of the invention are not limited to the specific assembly 10 as depicted in FIGS. 1-A, 1-B, or 1-C. In embodiments, the dimensions, e.g., width or length, of the assembly/panel may vary. Likewise, the dimensions of individual shingles, and the location of the fasteners 2, 3, may vary without departing from the scope of the invention.

Testing has demonstrated that this shingle assembly 10 does not break or fail in any manner when subjected to normal handling associated with manufacturing, packaging, and installation. The assembly will flex or bow a limited amount about the keyway axes, each joint providing gradually increasing resistance to excessive bowing, as is necessary to distribute forces encountered in typical handling, but the assembly does not break, and the butt line of the shingles installs as a straight line without attention to that alignment by the installer. The shingles are not connected to each other by any other means such as backer boards or bonding strips, and thus perform as properly installed conventional shingles.

As shown, the shingle assembly 10 also includes two horizontal rows of numbers, or rulers, to be used for registering the position of the next course of shingles. A lower ruler 5 is located just above the lower fasteners 2. An upper ruler 6 is located near the top 14 of the shingle assembly 10. Both the upper ruler 6 and lower ruler 5 include alignment guide marks 7 at an offset distance equal to $\frac{1}{3}^{rd}$ of the shingle-strip width. The upper and lower alignment guide marks 7 are aligned. The guide marks 7 are in the same position on every shingle-strip, regardless of shingle pattern. The alignment guide marks 7 provide a registration reference for offsetting the next course horizontally. The alignment guide marks 7 could be represented graphically in numerous ways and do not need to include numbers. The shingle assembly 10 is mounted to the wall or roof using two nails per shingle, following the same fastening conventions as specified by codes for individual shingles.

FIG. 1-B, and FIG. 1-C, are drawings of shingle assemblies 20, 30 that are identical to FIG. 1-A, except for variations in the shingle pattern. Shingle widths in these patterns vary from about 3-¼" to about 8-½". All three shingle patterns are interchangeable and use the same alignment guide marks in the same position. The installer does not need to be aware of shingle pattern variations. These pattern variations enable more efficient shingle inventory management, and further a random installation. Pattern variations are intermittently dispersed when the product is packed in cartons for delivery.

FIG. 2 shows a typical installed section 40 of shingle assemblies with keyway joints offset in this embodiment, a minimum of about 1-½" over 3 courses. The installation system is based on a matrix and may be defined and executed in numerous ways, but the embodiment shown here uses one of the simplest installation methods.

In use, installation begins by installing a first course 42 as a row of adjacent shingle assemblies 10, 20, 10, 30. Install the shingle assemblies allowing a keyway space 44 between shingle assemblies that is approximately the same width as the keyways 4 between shingles 1 in the shingle assemblies. The keyway space 44 in this embodiment is about 3/16".

Shingle assemblies are installed using two nails per shingle 1, just as with conventional individual shingles.

An installer may start the second course 46 anywhere, but typically in the middle and working toward the corners. Align the left edge 48 of the first shingle assembly 10 in the second course 46 with any of the alignment guide marks 7 (FIG. 1-A) in the first course 42. Adjust the height of the shingle assembly 10 to achieve the desired exposure, which is defined as the height of the exposed shingle in the previous course. In FIG. 2, the left edge 48 of the first installed shingle assembly 10 in the second course 46 is aligned with an alignment guide mark of the previous course, as are all subsequent shingle-strips in this course. After installing the first shingle assembly 10 of the course, continue installing adjacent shingle-strips to the left and right, with a keyway space 44 between shingle assemblies.

If the course crosses a door or window opening, register the first shingle-strip on the other side of the obstruction to any alignment guide mark in the previous course, and then continue installing adjacent shingle-strips from that point. If a course ends with a very narrow shingle segment, replace the last two shingles with a wider shingle from shingle-strip cut offs. Individual shingles are easily removed from the shingle-strip scraps. All other aspects of the installation such as inside and outside corners, are handled just as with conventional shingles. The third and fourth courses 50, 52 in FIG. 2 are installed following the same process as for the second course 46. Following the installation process results in proper joint offsets of at least 1-½" over 3 courses. Shingle-strips in this assembly include different patterns as shown in FIG. 1-A, FIG. 1-B, and FIG. 1-C.

Figure 3:
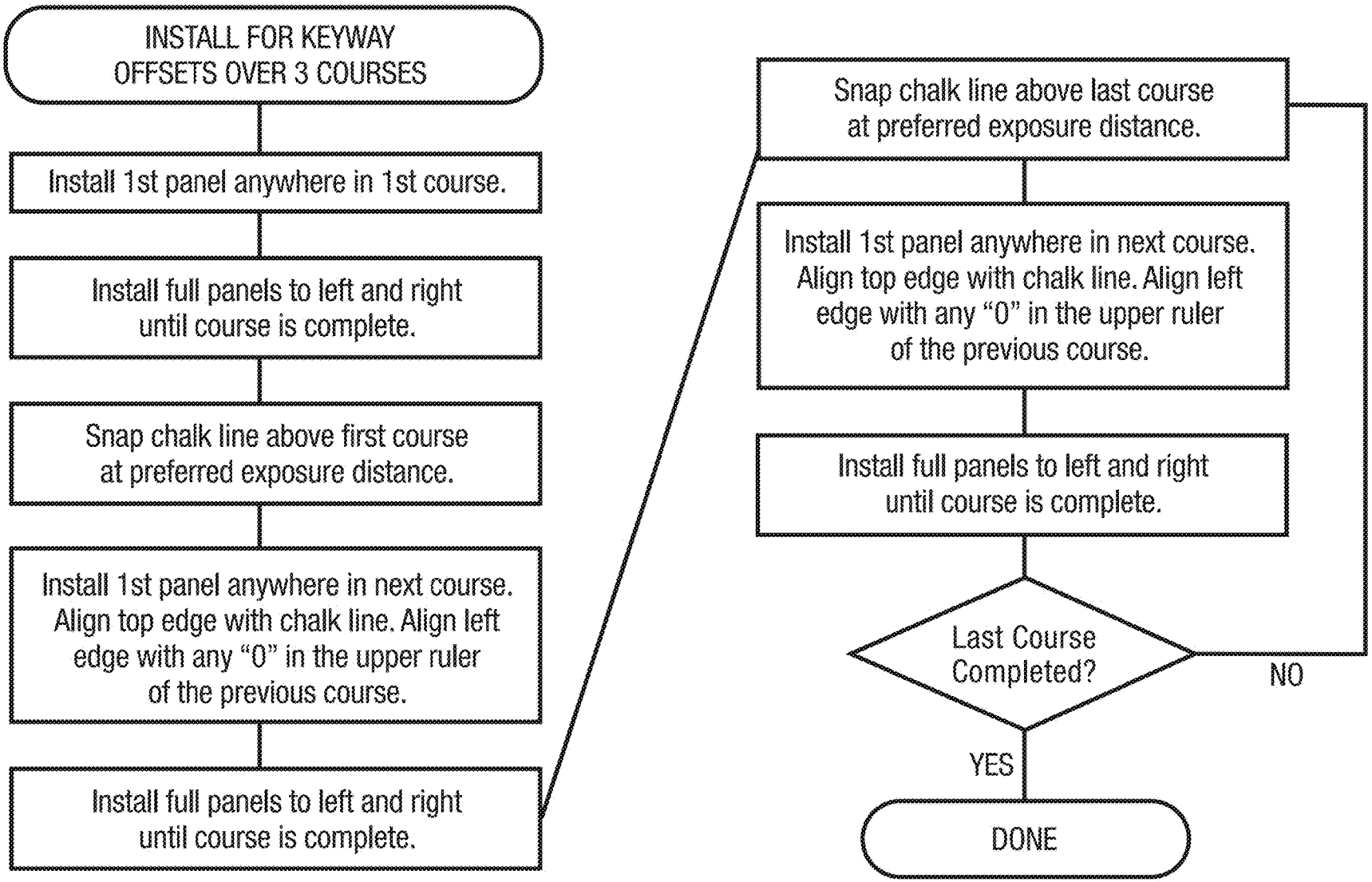
FIG. 3 is a flow diagram illustrating the steps for installing the shingle assembly of the present invention with keyways offset over 3 courses.

FIG. 3 is a flow diagram illustrating the steps involved in installing the shingle panels for proper keyway offset over any 3 consecutive courses.

Referring now to FIGS. 4-A and 4-B, in an embodiment, the clip/fastener 2, 3 used to secure shingles 1 together into a shingle assembly 10 has a crown width 60 of about 1-¼", and the leg length 62 is about ⅝". As will be appreciated, embodiments may utilize fasteners, e.g., staples, that are larger or smaller depending upon, for example, the thickness of a shingle, and the fasteners may be manufactured from a variety of materials via a variety of processes. In certain embodiments, the fasteners 2, 3 may be manufactured from stainless steel.

Turning now to FIG. 5-A, a machine, i.e., a manufacturing system 100 according to an embodiment is depicted. This end view is from an input or infeed end of the manufacturing system 100 and shows the butt end/edge 102 of a plurality of shingles 1, repositionable shingle positioning guides 104, a gun mount bar 106 for pneumatic fastener guns, and the position of the fasteners 108 in the fastener guns before the guns are activated, and the guns 112.

FIG. 5-A also shows the primary clinching mechanism 120 used to fold over the legs of the fastener 2 (e.g., staple) and a secondary clinching mechanism 130 which is utilized to press the folded legs of the fastener 2 into the underside/surface of the shingle so that the fastener ends does not protrude from the underside/surface of the shingle. This process is shown in FIG. 5-F, FIG. 5-G and FIG. 5-H, which are discussed in greater detail below.

Referring now to FIG. 5-B, FIG. 5-C and FIG. 5-D, in use, the gun mount bar 106 is pressurized against the shingles, and the primary clinching mechanism 120 is in the centered starting position (FIG. 5-B). The fasteners 2 are then driven through the shingle 1 via the fastener guns (FIG. 5-C). The gun mount bar 106 is used to hold the shingles down while the fasteners are driven through them. The bar may be locked in place by various mechanisms to prevent any potentially deleterious effects of gun recoil.

The primary clinching mechanism 120, which, in an embodiment, is a laterally movable bar that includes first and second protrusions, 122A and 122B, respectively. Each of the fasteners 2, when driven through the shingle 1, sit between a first protrusion 122A and a second protrusion 122B. The primary clinching mechanism 120 may then be moved in a first direction (FIG. 5-D) wherein the first protrusions 122A fold or clinch a leg of each fastener 2. The primary clinching mechanism 120 is then moved laterally in an opposite direction whereby the second protrusions 122B fold or clinch an opposite leg of each fastener 2 to secure the fastener 2 to the shingle 1. As will be appreciated, the protrusion need not be rounded as depicted and may be squared or cuboid in shape.

In embodiments, the primary clinching mechanism 120 is automated and may be operatively connected to, e.g., controller or control mechanism, that provides a signal to move the mechanism 120 after fasteners have been driven through a shingle assembly. Of course, in other embodiments, the mechanism 120 may be used activated.

After folding the legs of the fasteners 2, the primary clinching mechanism 120 is returned to its original center starting position in which the fasteners 2 sit between the first and second protrusions 122A and 122B (FIG. 5-F). At this point, a secondary clinching mechanism 130 is employed to push the ends of legs of the fasteners 2 into the back surface of the shingles 1.

More specifically, and referring to FIG. 5-G and FIG. 5-H, in a specific embodiment, the secondary clinching mechanism 130 has a base portion 132, such as bar or strip of metal or other rigid material, and a series of punches 134 or contact portions formed on or attached to the base portion 132, e.g., one punch 134 for each leg of the fastener 2. The punches 134 may have an angled distal tip as shown, so push the ends of the fastener legs into the underside of the shingle 1. In use, the punches may be selectively raised to contact and clinch the folded legs of the fasteners and then lowered out of contact with the fasteners.

In the depicted embodiment, the punches 134 extend upward through openings or apertures 124 in the primary clinching mechanism 120. In such embodiments, the primary and secondary clinching mechanisms may reside in a single laterally extending channel in a recessed clinching mechanism channel 150 in a deck portion 160 of the manufacturing system 100. In other embodiments, the primary and secondary clinching mechanisms may be in separate channels, or may be located on separate manufacturing equipment. Much like the primary clinching mechanism, operation of the secondary mechanism may be automated or it may be selectively actuated by a user.

Embedding the legs of the clips into the shingles provides structural stability that prevents the side-by-side shingles from skewing with respect to each other. This skewing would result in misaligned shingle butts, narrowing of the keyway spaces between shingles, and a narrower overall width of the assembly.

Referring now to FIG. 5-H, in use, the punches of the secondary clinching mechanism retract downward, and the gun hammers and gun mount bar retract upward, as needed for push bars to freely advance to the next fastening position.

Turning to FIG. 6-A, in an embodiment, the manufacturing system 100 includes a table or deck portion 160. The deck portion is substantially horizontal and is supported by a plurality of legs (not shown). In certain embodiments, the deck portion 160 may be a composite of two or more materials. That is, the deck may have a rigid base manufactured from, for example, plywood, and a synthetic top surface that contacts the shingles. The synthetic surface may be UHMW or another material that is durable and abrasion resistant, and has a low friction coefficient so that the shingles may readily slide/move thereon. In embodiments, the deck may be separated by the recessed clinching mechanism channel 150 into an infeed deck portion 162 and an outfeed deck portion 164.

FIG. 6-A is a top view of the assembly machine/manufacturing system 100. As depicted, six individual shingles 1 are loaded on the deck portion 160 between seven repositionable shingle guides. The shingles 1 are moved on the deck portion 160 and into position for joining via fasteners, through the use of conveyer push bars 170 which are operatively attached to a push bar chain drive 173. As shown, there are six fastener guns 112 mounted to the gun mount pressure bar 106. The figure further depicts the recessed clinching mechanism channel 150, the push bar position sensor 172, and the shingle sensor 174 which are used to facilitate automation of the manufacturing process. As will be appreciated, a variety of sensors may be utilized without departing from the scope of the invention.

In this embodiment of the assembly machine, one of the conveyor push bars 170 advances the shingles 1 to the fastening position while also automatically aligning the butts of the shingles 1. The conveyor push bars 170 are notched on the bottom to allow the push bar to pass over the shingle positioning guides 104 while maintaining contact with the deck portion 160. The conveyor push bar 170 stops at a programmed distance past the push bar sensor 172, in position for installation of the upper fastener 3. The shingle sensor 174 confirms that shingles 1 are loaded before beginning the fastener installation process. Once the upper fasteners 3 are installed, the push bar 170 advances the shingles 1 a programmed distance, stopping in position for installation of the lower clips 2.

Turning now to FIG. 6-B is a side view of the assembly machine/manufacturing system 100 of the present invention showing a set of individual shingles 1 advanced and aligned by the push bar 170 to a fastening position. Other components of the assembly machine shown in FIG. 6-B include the infeed deck portion 162, the gun mount bar 106, the fastener 2 as loaded in the fastener gun 112, the fastener gun hammer 113, and the primary clinching mechanism 120 in the clinching bar channel 150.

FIG. 6-C is a side view of the assembly machine of the present invention showing the gun mount bar pressurized downward to contact the shingles 1. FIG. 6-D is a side view of the assembly machine of the present invention showing the gun mount bar pressurized downward, the gun hammer pressurized downward, and the fasteners 2 driven through the shingles 1 into the clinching bar channel 150. The primary clinching mechanism 120 is in the centered position when the fasteners 2 are driven through the shingles 1.

Figure 7:
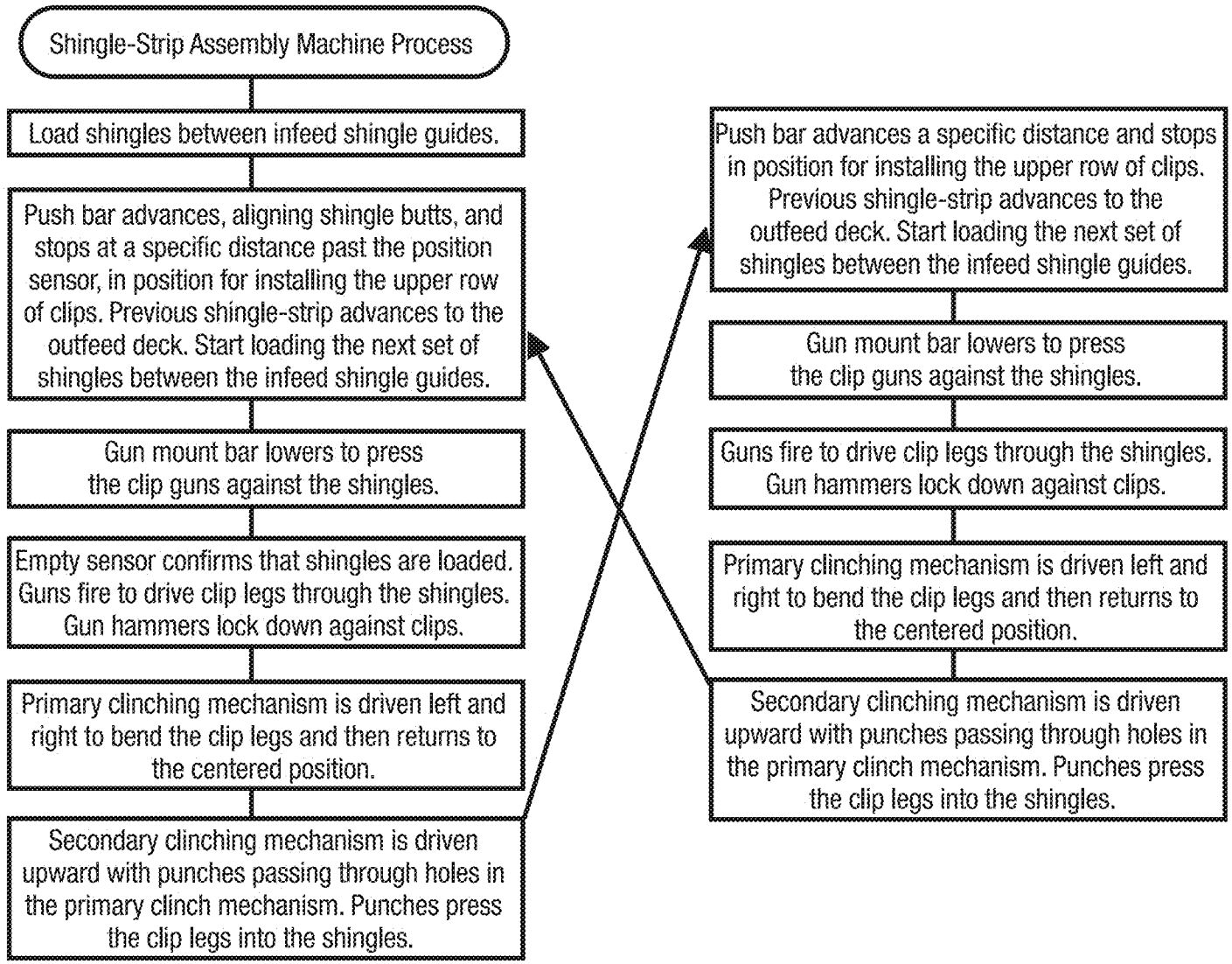
FIG. 7 is a flow diagram illustrating the steps for using the machine of the present invention to assemble a set of shingles as a shingle-strip.

FIG. 7 is a flow diagram illustrating the steps involved in using the assembly machine of the present invention to assemble a set of individual shingles as a shingle-strip, or panel.

Figure 8:
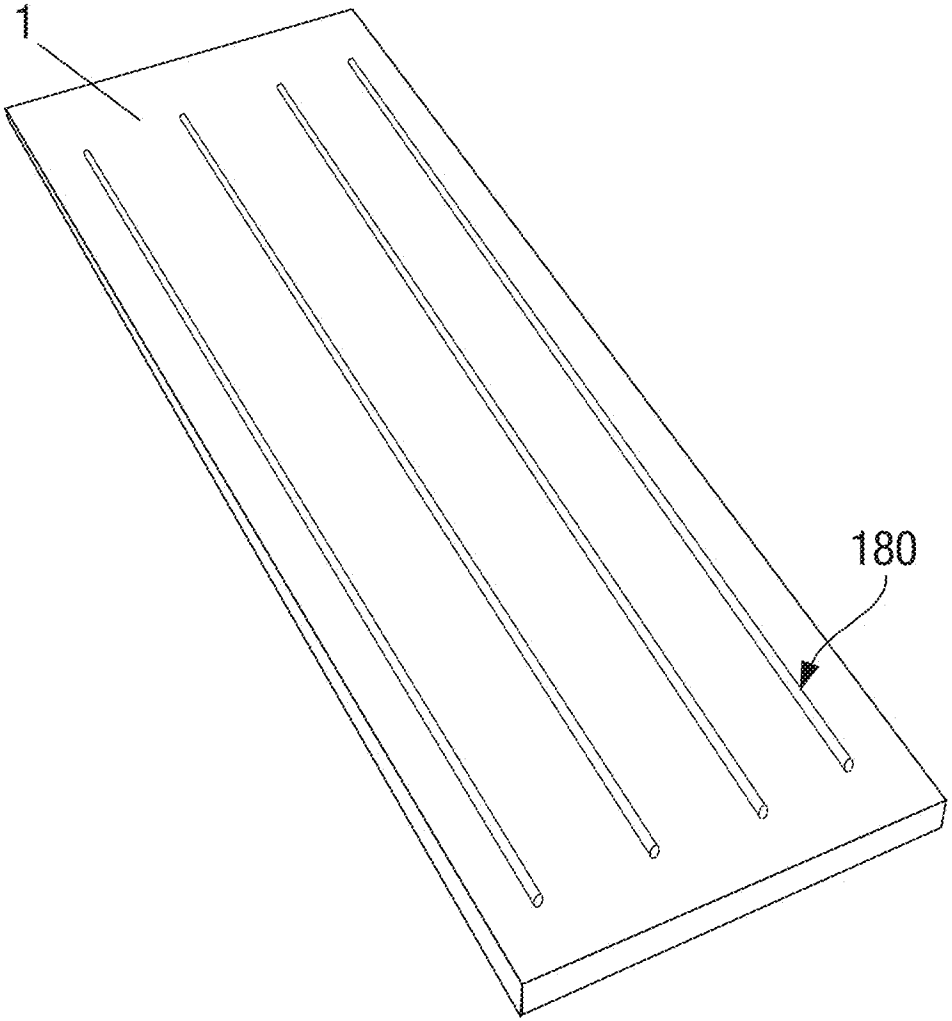
FIG. 8 is a perspective view of the ventilation beads or ridges on the back of the shingles of the present invention.

FIG. 8 is a perspective view of the back of a shingle illustrating the ventilation ridges 180. The ridges can be formed using a variety of techniques and products and the present invention is not limited to any particular method, although the described methods may in and of themselves be considered as novel. In an exemplary embodiment, the ridges are created from beads of hot melt adhesive. The ridges or beads on the back of the shingles should be close to one tenth of an inch in height. A 0.010" height is adequate for providing a rain-screen installation with adequate ventilation to depressurize solar vapor drive, and meets LEED specified rain-screen space requirements. It is also sufficient to provide a capillary break between successive courses that will work to isolate moisture to the top layer of shingles and will prevent trapped moisture between layers that can promote cupping and decay. The frequency of the ridges should be about one ridge every 1-½" of shingle width to maintain the gap between shingles, and a gap between shingles and the housewrap or sheathing even with slight natural distortions in the shingles. A ridge should be placed about ¾" from both side edges of every shingle to function as a baffle that will prevent windblown precipitation from moving sideways between courses to underlying keyway locations.

There are numerous alternative connector designs that would achieve the objectives of this invention. Connectors could attach to the shingles by other mechanical means, or could be bonded to the shingles with adhesives, while still providing adequate structural integrity to maintain consistent keyway spacing and shingle alignment during handling and installation without incorporating a bonding layer, which would compromise the shingle assembly performance compared to a conventional individual shingle installation.

Because the process described here provides an authentic shingle installation, that meets all code requirements and performance standards for conventional shingle installation, this invention can be used for projects where shingles are specified in the architectural plans. All other installation topics not discussed here should be performed in accordance with all of the same guidelines and code requirements established for conventional cedar shingle installation. For instance, sheathing, building wrap, flashing, and details such as doubling the first course, hips, ridges, corners, etc., are all handled the same way as for conventional installation of individual shingles.

It should be appreciated that the present invention may also be applied in embodiments in which the width of the panel, or the height of the shingles may vary. For instance, typical shingle heights are 14, 16, 18, and 24 inches. For shakes, typical heights are 18 and 24 inches. In one embodiment of the invention, the panel may use various heights in the same panel to create a staggered look. Panels may also be comprised of custom shingle shapes or patterns such as waves, fish scale shapes, diamond patterns, etc. Other embodiments may utilize different types of spacers or clips between the shingles as a structural element, and to ensure that the shingles are parallel to each other.

Figure 9:
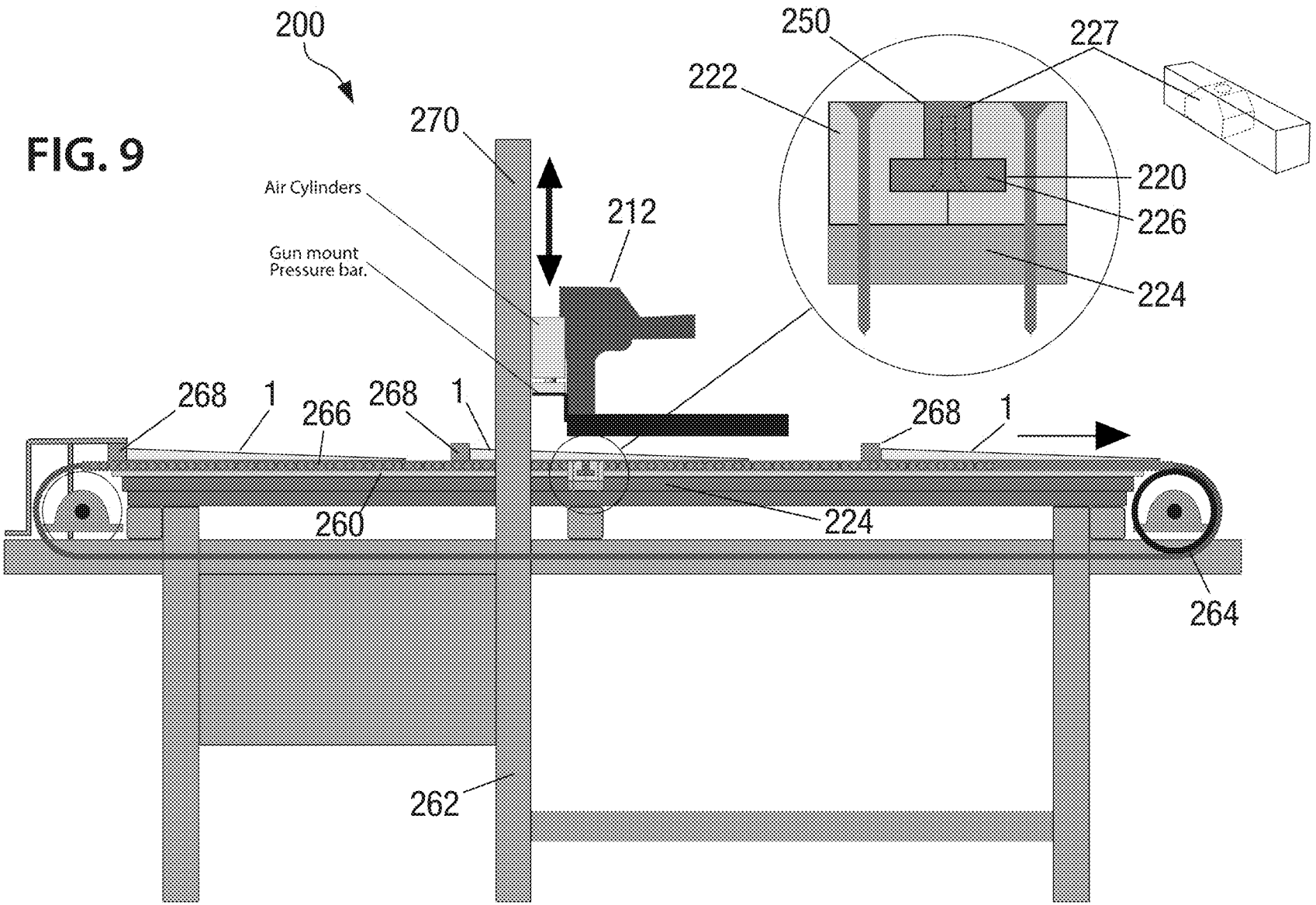
FIG. 9 is a detailed side view of a machine for manufacturing a shingle assembly in accordance with an embodiment of the invention.
Figure 10:
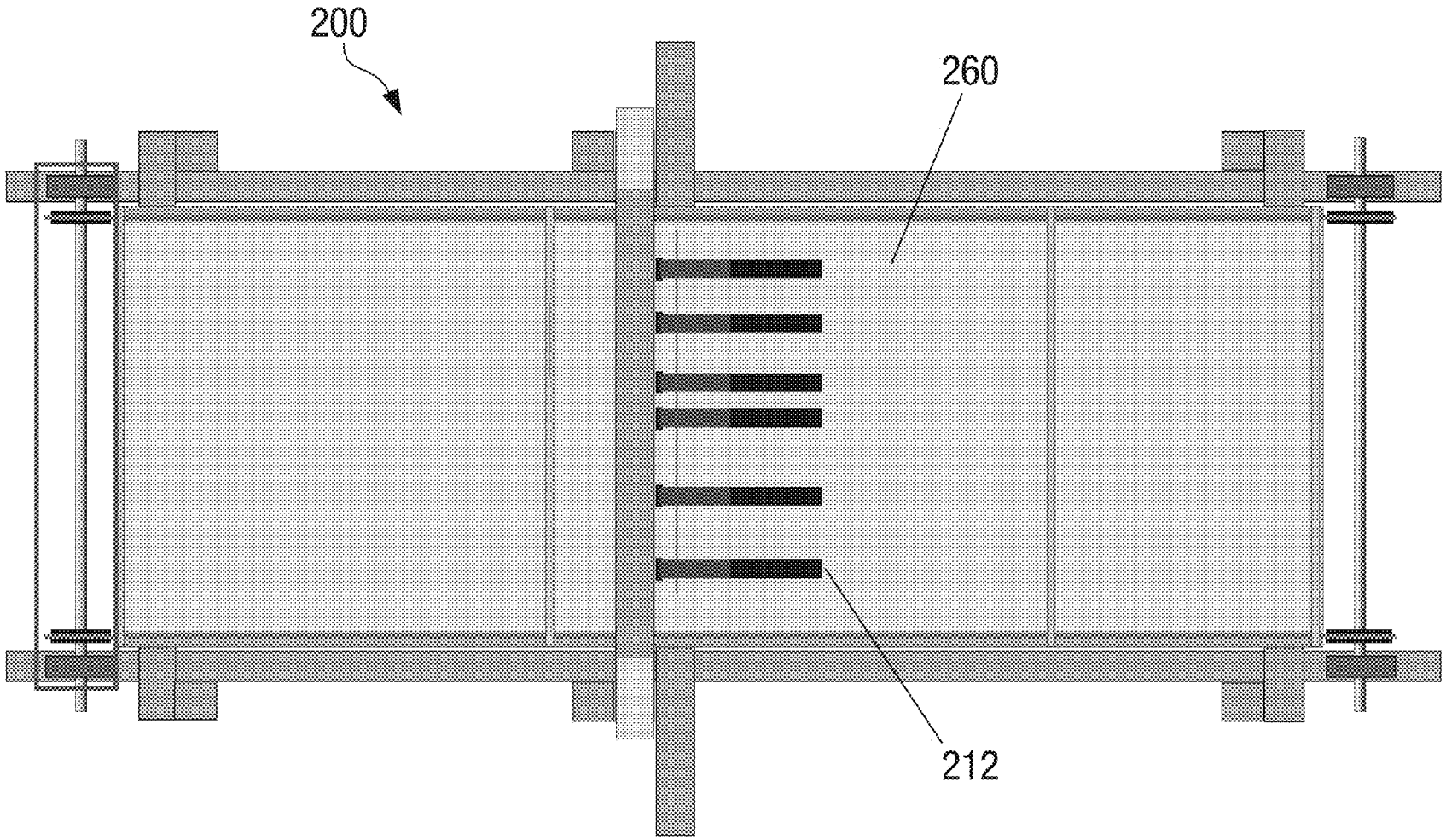
FIG. 10 is a detailed top view of the machine of FIG. 9.

Referring now to FIGS. 9 and 10, in an embodiment, the manufacturing system 200. In The depicted embodiment, the nose of each fastening gun 212 presses into the shingle 1 and is secured in place to prevent recoil during discharge, that is, there is no pressure bar that contacts the shingles 1. As depicted, the deck portion 260 includes a channel 250 that includes the first clinching mechanism 220. The first clinching mechanism 220 sits in a closely fitting channel 250 that is formed in a section of UHMW 222 which sits on the plywood base 224. The channel 250 allows the first clinching mechanism 220 (which has a plurality of protrusions 227 secured to a base bar portion 226) to move laterally back and forth to function as described above. As shown, the deck portion 260 (which includes a plywood base and a UHMW surface) is secured to a support structure 262 having a plurality of legs. Servo motors 264 rotate to move a chain 266 that is operatively attached to and moves push bars 268 that urge shingles 1 into position for fastening. The fastening guns 212 travel in a substantially vertical linear path up and down via a guide structure 270. In the depicted embodiment, dual guide rod air cylinders are utilized to raise and lower the guns 212.

Figure 11:
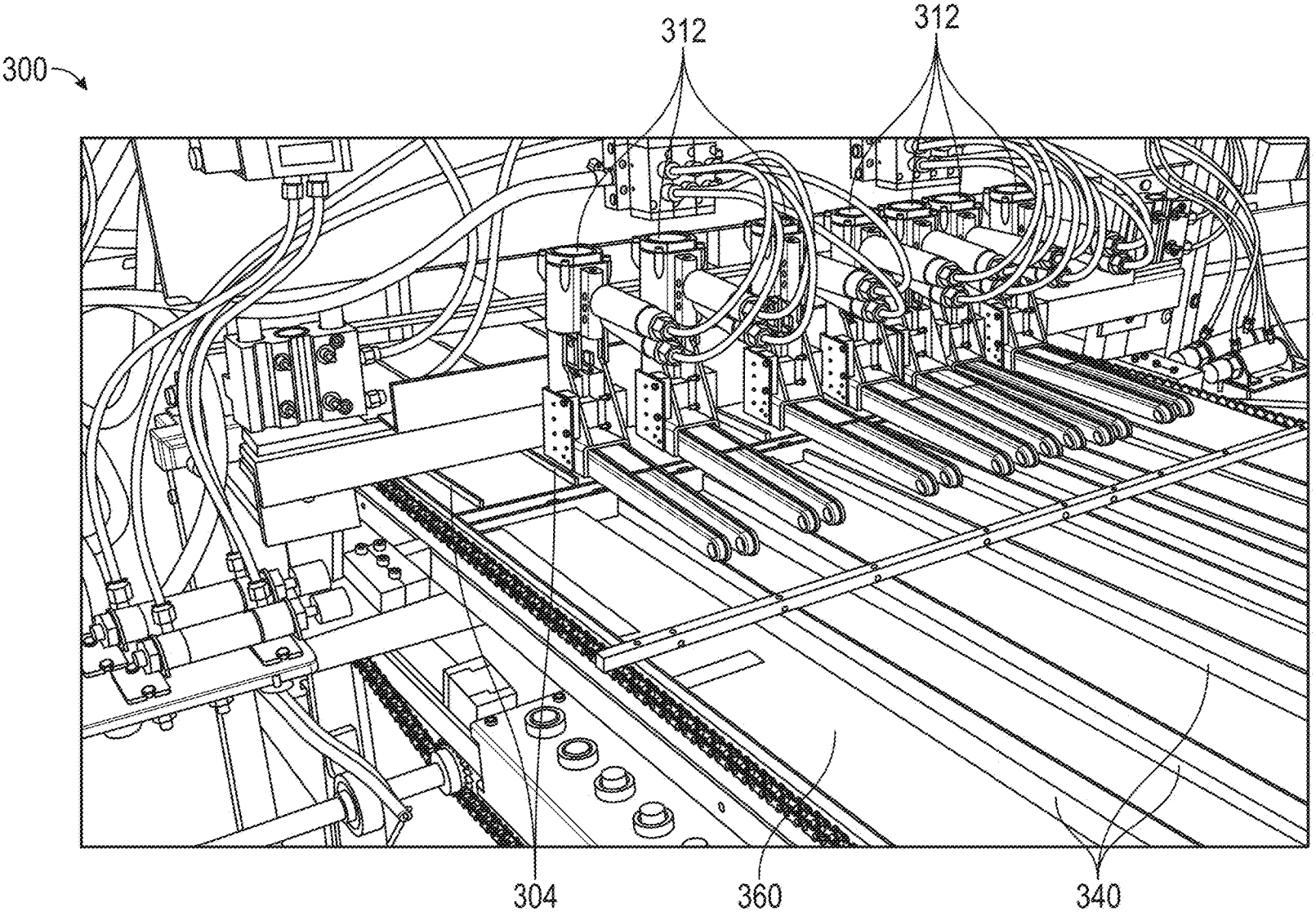
FIG. 11 is a photograph of another embodiment of a machine for manufacturing a shingle assembly.

FIG. 11 is a picture of a manufacturing system 300 according to another embodiment of the invention. In this embodiment, eight shingles (not shown) are assembled into a panel via fasteners from seven fastener guns 312. The shingle position guides 304 are shown on the deck portion 360. In this embodiment, the deck portion 160 further includes a section that includes a features a plurality of longitudinal channels 340 which are sized and shaped to allow shingles to be urged out of the system 300 by the push bars 368 without the staples damaging the UHMW surface of the deck portion 160.

Figure 12:
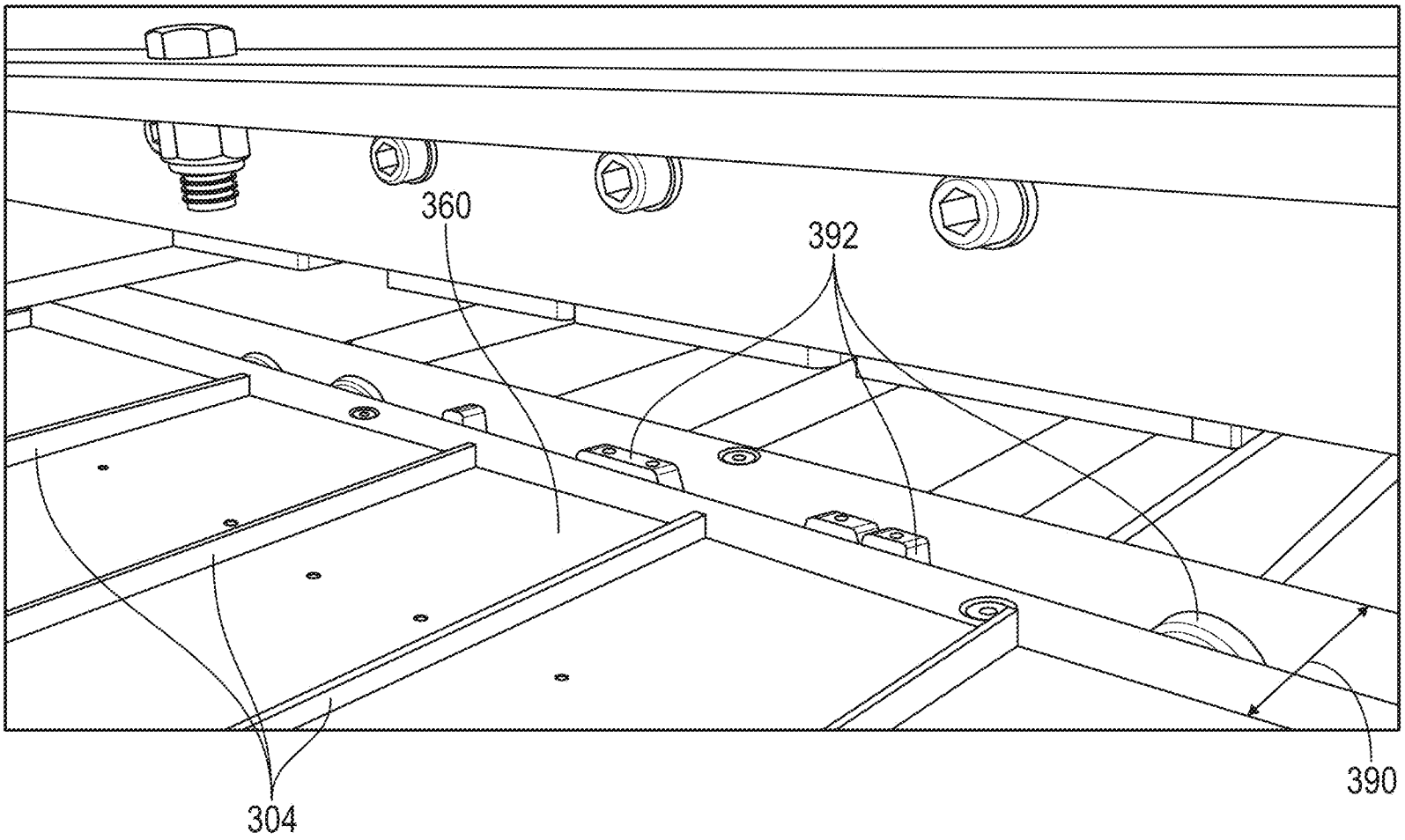
FIG. 12 is another photograph of the machine of FIG. 11.

FIG. 12 depicts the lateral channel 390 that houses the primary clinching mechanism. The protrusions 392 of the mechanism move back and forth in channel 390 to fold over the legs of fasteners (not shown).

Embodiments of the invention may utilize pneumatic systems that employ compressed air. Such systems may use solenoid valves to control movement and/or operation of various components. The solenoid valves may be electronically interconnected to a controller to automate various portions of the manufacturing process, e.g., advancing and fastening shingles.

In embodiments, the secondary clinching mechanism may be housed in a separate table/manufacturing station. In certain embodiments, that same station having the secondary clinching mechanism may also include a saw that trims the shingles of a shingle assembly to a single uniform length.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A method of manufacturing an assembly of shingles comprising: aligning a plurality of shingles on a deck portion of a manufacturing system;

driving at least one fastener through adjacent shingles of the plurality of shingles;

folding over legs of the at least one fastener via a first clinching mechanism; and pressing the legs of the at least one fastener into an underside of the adjacent shingles via a second clinching mechanism.

2. The method of claim 1 further comprising: removing the assembly of shingles from the manufacturing system.

3. The method of claim 1 wherein the manufacturing system includes a mechanism to advance the plurality of shingles on the deck portion into a fastening position for connection via the at least one fastener; at least one sensor to detect a presence and/or location of the plurality of shingles on the deck portion;

wherein manufacturing the assembly is automated via the mechanism and at least one sensor.

4. The method of claim 1 wherein the at least one fastener is a clip having a crown width of about 1-¼", and a leg length of about ⅝".

5. The method of claim 1 wherein the at least one fastener is driven through the adjacent shingles via a linear actuator.

6. The method of claim 1 wherein the at least one fastener is driven through the adjacent shingles via a pneumatic gun.

7. The method of claim 1 wherein the plurality of shingles are held to the deck portion via a bar while the legs of the at least one fastener are folded over and pressed into the underside of the adjacent shingles.

8. The method of claim 1 wherein the first clinching mechanism is a movable bar that includes first protrusions and second protrusions, and folding over the legs further comprises:

moving the first clinching mechanism in a first direction wherein the first protrusions fold over a leg of the at least one fastener;

moving the first clinching mechanism in a second direction opposite the first direction whereby the second protrusions fold over an opposite leg of the at least one fastener.

9. The method of claim 1 wherein the second clinching mechanism includes at least one contact portion located on a base portion;

wherein, in use, the at least one contact portion may be selectively raised to contact and press the folded legs of the at least one fastener into an underside of the adjacent shingles, and then lowered out of contact with the at least one fastener.

10. The method of claim 9 wherein the at least one contact portion are two contact portions that, when raised, extend upward through openings in the first clinching mechanism.

11. The method of claim 1 wherein the at least one fastener is an upper fastener and a lower fastener.

12. A system for manufacturing an assembly of shingles comprising:

a deck portion configured to receive a plurality of shingles;

at least one fastener drive mechanism operatively connected to the deck portion, the at least one fastener drive mechanism configured to drive a fastener through adjacent shingles of the plurality of shingles to connect the adjacent shingles;

a first clinching mechanism configured to fold over legs of the fastener; and a second clinching mechanism configured to press the legs of the fastener into an underside of the adjacent shingles.

13. The system of claim 12 further comprising:

a mechanism to advance the plurality of shingles on the deck portion into a fastening position for connection via the fastener; and at least one sensor to detect a presence and/or location of the plurality of shingles on the deck portion;

wherein manufacturing the assembly is automated via the mechanism and at least one sensor.

14. The system of claim 12 wherein the at least one fastener drive mechanism is a pneumatic fastener gun.

15. The system of claim 12 wherein the at least one fastener drive mechanism is connected to a mount bar which is configured to hold the plurality of shingles to the deck portion while the legs of the fastener are folded over and pressed into the underside of the adjacent shingles.

16. The system of claim 12 wherein the first clinching mechanism is a movable bar that includes at least one first protrusion and at least one second protrusion;

wherein the at least one first protrusion folds over a leg of the fastener when the first clinching mechanism is moved in a first direction;

wherein the at least one second protrusion folds over an opposite leg of the fastener when the first clinching mechanism is moved in a second direction opposite the first direction.

17. The system of claim 12 wherein the second clinching mechanism includes at least one contact portion located on a base portion;

wherein, in use, the at least one contact portion may be selectively raised to contact and press the folded legs of a fastener into an underside of the adjacent shingles, and then lowered out of contact with the fastener.

18. The system of claim 12 wherein the deck portion includes a recessed clinching mechanism channel; wherein the first clinching mechanism and the second clinching mechanism are located within the recessed clinching mechanism channel.

19. The system of claim 18 wherein second clinching mechanism includes two contact portions that may be selectively raised to extend upward through openings in the first clinching mechanism to press the folded legs of the fastener into an underside of adjacent shingles and then lowered out of contact with the fastener.

20. The system of claim 12 wherein the mechanism to advance the plurality of shingles on the deck portion is a push bar.

* * * * *